US010012932B2

(12) United States Patent
Ishigaya et al.

(10) Patent No.: US 10,012,932 B2
(45) Date of Patent: Jul. 3, 2018

(54) IMAGE FORMING APPARATUS INCORPORATING FIXING DEVICE

(71) Applicants: Yasunori Ishigaya, Kanagawa (JP); Ryuuichi Mimbu, Kanagawa (JP); Hiromasa Takagi, Tokyo (JP); Toshihiko Shimokawa, Kanagawa (JP); Kazuya Saito, Kanagawa (JP); Keitaro Shoji, Kanagawa (JP)

(72) Inventors: Yasunori Ishigaya, Kanagawa (JP); Ryuuichi Mimbu, Kanagawa (JP); Hiromasa Takagi, Tokyo (JP); Toshihiko Shimokawa, Kanagawa (JP); Kazuya Saito, Kanagawa (JP); Keitaro Shoji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/401,668

(22) Filed: Jan. 9, 2017

(65) Prior Publication Data

US 2017/0212457 A1 Jul. 27, 2017

(30) Foreign Application Priority Data

Jan. 25, 2016 (JP) ..... 2016-011505

(51) Int. Cl.
*G03G 15/20* (2006.01)

(52) U.S. Cl.
CPC ..... *G03G 15/2039* (2013.01)

(58) Field of Classification Search
CPC ..... G03G 15/5004; G03G 15/20; G03G 15/2039; G03G 15/80
See application file for complete search history.

(56) References Cited

U.S. PATENT DOCUMENTS

2004/0245241 A1 12/2004 Kishi et al.
2005/0123315 A1 6/2005 Kishi et al.
(Continued)

FOREIGN PATENT DOCUMENTS

JP 4-044083 2/1992
JP 2004226888 A * 8/2004
(Continued)

OTHER PUBLICATIONS

Kawasaki et al. (JP 2004-226888 A), Aug. 2004, JPO Computer Translation.*

*Primary Examiner* — Erika J Villaluna
(74) *Attorney, Agent, or Firm* — Oblon, McClelland, Maier & Neustadt, L.L.P.

(57) ABSTRACT

An image forming apparatus includes a fixing device to fix a toner image onto a recording medium, a voltmeter to measure an input voltage from an external source, and a controller operatively connected to the fixing device and the voltmeter. The fixing device includes an endless, fixing rotator formed into a loop, a heater to heat the fixing rotator, a pressure pad disposed inside the loop, and a pressure rotator disposed opposite the pressure pad via the fixing rotator to press the fixing rotator against the pressure pad to form a fixing nip between the fixing rotator and the pressure rotator, through which the recording medium bearing the toner image is conveyed. The controller controls a heating operation of the heater and a fixing operation of the fixing device to fix the toner image onto the recording medium, based on the input voltage measured by the voltmeter.

12 Claims, 12 Drawing Sheets

(56) References Cited

U.S. PATENT DOCUMENTS

| | | | | |
|---|---|---|---|---|
| 2005/0139584 | A1 | 6/2005 | Kishi et al. | |
| 2006/0051119 | A1 | 3/2006 | Kishi et al. | |
| 2006/0237446 | A1 | 10/2006 | Kishi et al. | |
| 2007/0031159 | A1 | 2/2007 | Kishi et al. | |
| 2007/0292175 | A1 | 12/2007 | Shinshi | |
| 2008/0304852 | A1 | 12/2008 | Kishi | |
| 2009/0123172 | A1 | 5/2009 | Kishi et al. | |
| 2009/0317113 | A1 | 12/2009 | Kishi et al. | |
| 2011/0085815 | A1 | 4/2011 | Kishi et al. | |
| 2011/0211876 | A1* | 9/2011 | Iwaya | G03G 15/2085 399/323 |
| 2011/0229180 | A1 | 9/2011 | Saito | |
| 2012/0045226 | A1 | 2/2012 | Hase et al. | |
| 2013/0202320 | A1 | 8/2013 | Hase et al. | |
| 2014/0072355 | A1* | 3/2014 | Tamaki | G03G 15/2017 399/329 |
| 2014/0099138 | A1 | 4/2014 | Ishigaya et al. | |
| 2014/0226999 | A1 | 8/2014 | Kishi | |
| 2014/0227001 | A1 | 8/2014 | Kishi et al. | |
| 2015/0212459 | A1 | 7/2015 | Hase et al. | |

FOREIGN PATENT DOCUMENTS

| | | |
|---|---|---|
| JP | 2004-286922 | 10/2004 |
| JP | 2006-324226 | 11/2006 |
| JP | 2007-171990 | 7/2007 |
| JP | 2007-221996 | 8/2007 |
| JP | 2007-334205 | 12/2007 |
| JP | 2008-217823 | 9/2008 |
| JP | 2008-304864 | 12/2008 |
| JP | 2011-180220 | 9/2011 |
| JP | 2013-013321 | 1/2013 |
| JP | 2014-178667 | 9/2014 |
| JP | 2014-178668 | 9/2014 |
| JP | 2015-004797 | 1/2015 |
| JP | 2015-094813 | 5/2015 |
| JP | 2015-165277 | 9/2015 |

* cited by examiner

| FIG. 14A |
| --- |
| FIG. 14B |

IMAGE FORMING APPARATUS INCORPORATING FIXING DEVICE

CROSS-REFERENCE TO RELATED APPLICATION

This patent application is based on and claims priority pursuant to 35 U.S.C. § 119(a) to Japanese Patent Application No. 2016-011505, filed on Jan. 25, 2016, in the Japan Patent Office, the entire disclosure of which is hereby incorporated by reference herein.

BACKGROUND

Technical Field

Embodiments of the present disclosure generally relate to an image forming apparatus incorporating a fixing device, and more particularly, to an image forming apparatus for forming an image on a recording medium, incorporating a fixing device for fixing a toner image onto a recording medium.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, the image is formed on the recording medium.

Such a fixing device typically includes a fixing rotator such as a roller, a belt, or a film, and an opposed rotator such as a roller or a belt pressed against the fixing rotator. The toner image is fixed onto the recording medium under heat and pressure while the recording medium is conveyed between the fixing rotator and the opposed rotator.

SUMMARY

In one embodiment of the present disclosure, a novel image forming apparatus is described that includes a fixing device, a voltmeter, and a controller. The fixing device fixes a toner image onto a recording medium. The fixing device includes an endless, fixing rotator, a heater, a pressure pad, and a pressure rotator. The fixing rotator is rotatable in a given direction of rotation and formed into a loop. The heater heats the fixing rotator. The pressure pad is disposed inside the loop formed by the fixing rotator. The pressure rotator is disposed opposite the pressure pad via the fixing rotator to press the fixing rotator against the pressure pad to form a fixing nip between the fixing rotator and the pressure rotator, through which the recording medium bearing the toner image is conveyed. The voltmeter measures an input voltage from an external source. The controller is operatively connected to the fixing device and the voltmeter. The controller controls a heating operation of the heater and a fixing operation of the fixing device to fix the toner image onto the recording medium, based on the input voltage measured by the voltmeter.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
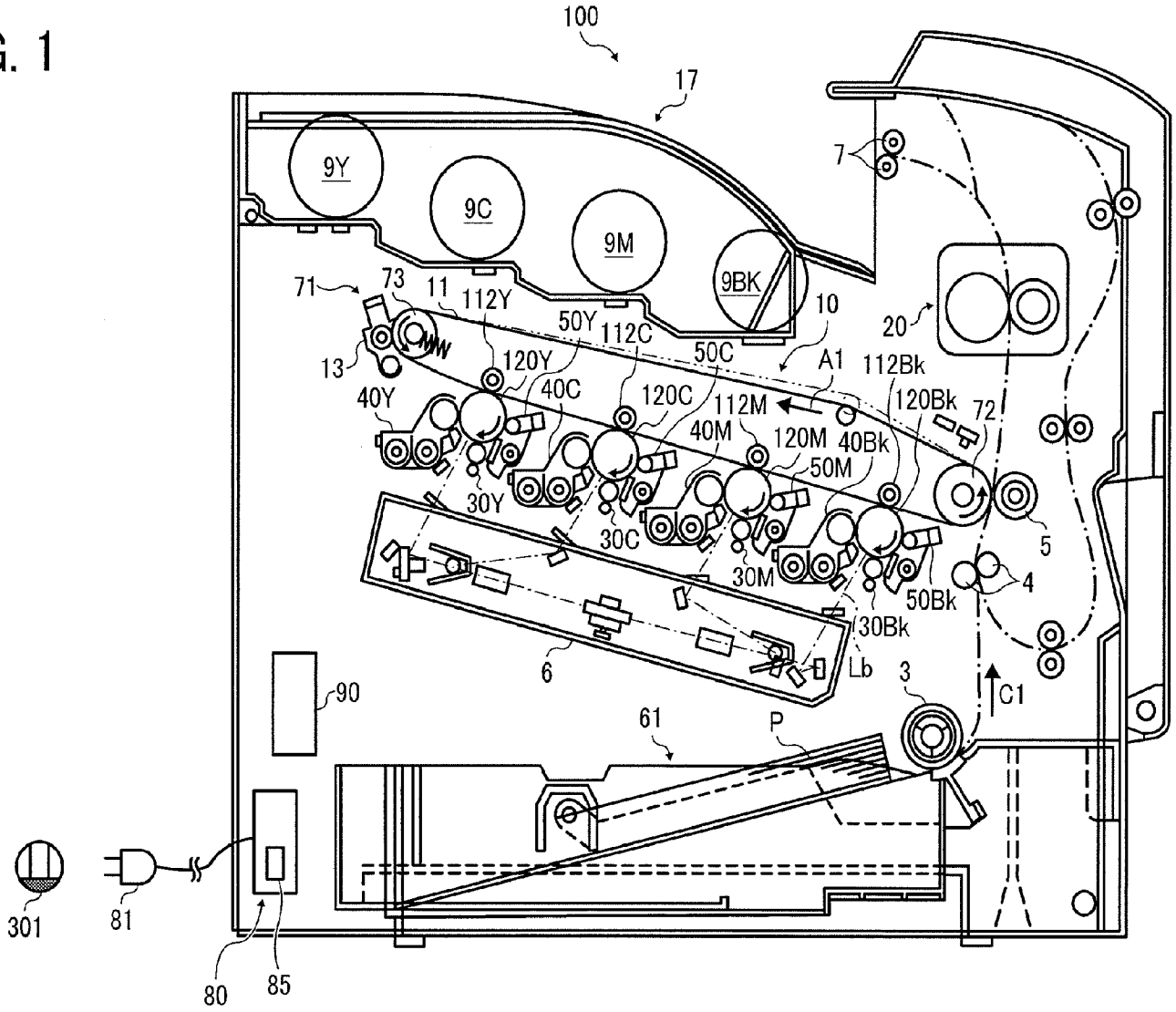
FIG. 1 is a schematic view of an image forming apparatus according to an embodiment of the present disclosure.

In describing embodiments illustrated in the drawings, specific terminology is employed for the sake of clarity.

However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and Bk denote colors yellow, cyan, magenta, and black, respectively. To simplify the description, these suffixes are omitted unless necessary.

Referring now to the drawings, embodiments of the present disclosure are described below.

Initially with reference to FIG. 1, a description is given of an image forming apparatus 100 according to an embodiment of the present disclosure.

FIG. 1 is a schematic view of the image forming apparatus 100.

The image forming apparatus 100 is a color laser printer that forms color and monochrome toner images on a recording medium by electrophotography. The image forming apparatus 100 includes an image station centrally located in a housing of the image forming apparatus 100. The image station is constructed of four image forming devices that form different color toner images.

The image forming apparatus 100 employs a tandem structure in which the image forming devices are arranged side by side in a direction in which an endless, intermediate transfer belt 11 as an intermediate transfer body is extended. The image forming devices have identical configurations, except that the image forming devices contain developers of different colors, that is, yellow (Y), cyan (C), magenta (M), and black (Bk) corresponding to color-separation components of a color image.

Specifically, the image forming apparatus 100 includes photoconductive drums 120Y, 120C, 120M, and 120Bk arranged side by side. The photoconductive drums 120Y, 120C, 120M, and 120Bk are image bearers that respectively bear toner images of yellow, cyan, magenta, and black in separation colors.

In a primary transfer process, the toner images formed on the photoconductive drums 120Y, 120C, 120M, and 120Bk as visible images are primarily transferred on the intermediate transfer belt 11, disposed opposite the photoconductive drums 120Y, 120C, 120M, and 120Bk and rotatable in a rotational direction A1, at primary transfer areas where the intermediate transfer belt 11 meets the photoconductive drums 120Y, 120C, 120M, and 120Bk. Specifically, the toner images of yellow, cyan, magenta, and black are transferred onto the intermediate transfer belt 11 from the photoconductive drums 120Y, 120C, 120M, and 120Bk, respectively, while being superimposed one atop another as the intermediate transfer belt 11 rotates. Thereafter, in a secondary transfer process, the toner images of yellow, cyan, magenta, and black superimposed on the intermediate transfer belt 11 are secondarily transferred onto a sheet P as a recording medium collectively.

Each of the photoconductive drums 120Y, 120C, 120M, and 120Bk is surrounded by various pieces of image forming equipment. The various pieces of image forming equipment form a toner image on the photoconductive drum 120 while the photoconductive drum 120 rotates clockwise in FIG. 1.

For example, the photoconductive drum 120Bk is surrounded by a charger 30Bk, a developing device 40Bk, a primary transfer roller 112Bk as a primary transfer device, and a cleaner 50Bk in this order in a clockwise rotational direction of the photoconductive drum 120Bk as illustrated in FIG. 1. Similarly, the photoconductive drums 120Y, 120C, and 120M are surrounded by chargers 30Y, 30C, and 30M, developing devices 40Y, 40C, and 40M, primary transfer rollers 112Y, 112C, and 112M, and cleaners 50Y, 50C, and 50M in this order in the rotational direction of the photoconductive drums 120Y, 120C, and 120M, respectively. After the charger 30Bk charges the photoconductive drum 120Bk, an optical writing device 6, as an exposure device that exposes the surface of the photoconductive drum 120Bk, writes an electrostatic latent image on the photoconductive drum 120Bk.

The optical writing device 6 includes, e.g., a semiconductor laser as a light source, a coupling lens, an fθ lens, a toroidal lens, a turning mirror, and a polygon mirror as a deflector. The optical writing device 6 irradiates the surface of the photoconductive drums 120Y, 120C, 120M, and 120Bk with laser beams Lb according to image data to form electrostatic latent images on the surface of the photoconductive drums 120Y, 120C, 120M, and 120Bk.

As the intermediate transfer belt 11 rotates in the rotational direction A1, the visible toner images of yellow, cyan, magenta, and black respectively formed on the photoconductive drums 120Y, 120C, 120M, and 120Bk are primarily transferred onto the intermediate transfer belt 11 while being superimposed on a same position on the intermediate transfer belt 11. Thus, a composite toner image is formed on the intermediate transfer belt 11.

More specifically, a primary transfer bias is applied to each of the primary transfer rollers 112Y, 112C, 112M, and 112Bk disposed opposite the photoconductive drums 120Y, 120C, 120M, and 120Bk via the intermediate transfer belt 11, respectively. The primary transfer rollers 112Y, 112C, 112M, and 112Bk each being supplied with the primary transfer bias superimpose and thus successively transfer the toner images of yellow, cyan, magenta, and black from the photoconductive drums 120Y, 120C, 120M, and 120Bk, respectively, onto the intermediate transfer belt 11 rotating in the rotational direction A1.

The primary transfer rollers 112Y, 112C, 112M, and 112Bk sandwich the intermediate transfer belt 11 together with the respective photoconductive drums 120Y, 120C, 120M, and 120Bk, thereby forming the primary transfer areas, herein referred to as primary transfer nips, between the intermediate transfer belt 11 and the photoconductive drums 120Y, 120C, 120M, and 120Bk. A power supply 80 is coupled to each of the primary transfer rollers 112Y, 112C, 112M, and 112Bk. The power supply 80 applies the primary transfer bias including at least one of predetermined direct current (DC) voltage and alternating current (AC) voltage to each of the primary transfer rollers 112Y, 112C, 112M, and 112Bk.

As illustrated in FIG. 1, the photoconductive drums 120Y, 120C, 120M, and 120Bk are arranged in this order from an upstream side in the rotational direction A1. The photoconductive drums 120Y, 120C, 120M, and 120Bk are accommodated in the image forming devices that form the toner images of yellow, cyan, magenta, and black, respectively.

In addition to the image forming devices, the image forming apparatus 100 includes a transfer belt unit 10, a secondary transfer roller 5, a transfer belt cleaner 13, and the optical writing device 6.

The transfer belt unit 10 includes the intermediate transfer belt 11, the primary transfer rollers 112Y, 112C, 112M, and 112Bk, and a plurality of belt supporters, such as a drive roller 72 and a driven roller 73, around which the intermediate transfer belt 11 is entrained. As the drive roller 72 is driven to rotate, the intermediate transfer belt 11 rotates in the rotational direction A1.

The drive roller 72 is disposed opposite the secondary transfer roller 5 via the intermediate transfer belt 11, thereby serving as a secondary transfer backup roller. On the other hand, the driven roller 73 is disposed opposite the transfer belt cleaner 13 via the intermediate transfer belt 11, thereby serving as a cleaning backup roller. The driven roller 73 is provided with a biasing member such as a spring to stretch the intermediate transfer belt 11 tight. A transfer device 71 is constructed of the transfer belt unit 10, the secondary transfer roller 5, and the transfer belt cleaner 13.

The secondary transfer roller 5 is disposed opposite the intermediate transfer belt 11 and rotates in accordance with rotation of the intermediate transfer belt 11. The secondary transfer roller 5 sandwiches the intermediate transfer belt 11 together with the drive roller 72 as the secondary transfer backup roller, thereby forming a secondary transfer area herein referred to as a secondary transfer nip between the secondary transfer roller 5 and the intermediate transfer belt 11.

Similar to the primary transfer rollers 112Y, 112C, 112M, and 112Bk, the power supply 80 is coupled to the secondary transfer roller 5. The power supply 80 applies a secondary transfer bias including at least one of the predetermined DC voltage and AC voltage to the secondary transfer roller 5.

The transfer belt cleaner 13 is disposed opposite the driven roller 73 via the intermediate transfer belt 11 to clean an outer circumferential surface of the intermediate transfer belt 11. For example, the transfer belt cleaner 13 includes a cleaning brush and a cleaning blade that contact the outer circumferential surface of the intermediate transfer belt 11. A waste toner conveyance tube extending from the transfer belt cleaner 13 to an inlet of a waste toner container conveys waste toner collected from the intermediate transfer belt 11 by the transfer belt cleaner 13 to the waste toner container.

The image forming apparatus 100 further includes a sheet feeder 61, a registration roller pair 4 as a sheet sender, and a sheet leading-end sensor that detects a leading end of the sheet P.

The sheet feeder 61 is disposed in a lower portion of the housing of the image forming apparatus 100. The sheet feeder 61 includes a sheet tray on which a plurality of sheets P as recording media rest and a feed roller 3 that contacts an uppermost sheet P of the plurality of sheets P resting on the sheet tray. The feed roller 3 is driven to rotate counterclockwise in FIG. 1 to pick up and feed the sheet P from the sheet tray to the registration roller pair 4.

In the housing of the image forming apparatus 100 is a conveyance passage defined by internal components of the image forming apparatus 100. Along the conveyance passage, the sheet P is conveyed from the sheet feeder 61 to a sheet ejection roller pair 7 via the secondary transfer nip. The sheet ejection roller pair 7 ejects the sheet P outside the housing of the image forming apparatus 100. The registration roller pair 4 is disposed along the conveyance passage, upstream from the secondary transfer roller 5 in a sheet conveyance direction C1 as a recording medium conveyance direction. The registration roller pair 4 conveys the sheet P to the secondary transfer nip.

Specifically, the activation of the registration roller pair 4 is timed to send the sheet P conveyed from the sheet feeder 61 to the secondary transfer nip formed between the secondary transfer roller 5 and the intermediate transfer belt 11 such that the toner image formed on the intermediate transfer belt 11 in the image station constructed of the plurality of image forming devices meets the sheet P at the secondary transfer nip. The sheet leading-end sensor detects that the leading end of the sheet P arrives at the registration roller pair 4.

The sheets P as recording media may be plain paper, thick paper, postcards, envelopes, thin paper, coated paper, art paper, tracing paper, overhead projector (OHP) transparencies, and the like. Optionally, a bypass feeder may be provided to feed a sheet P manually.

The image forming apparatus 100 further includes a fixing device 20, the sheet ejection roller pair 7, and an output tray 17. After the toner image is transferred on the sheet P at the secondary transfer nip, the sheet P bearing the toner image is conveyed to the fixing device 20, which fixes the toner image onto the sheet P. The sheet P bearing the fixed toner image is then conveyed to the sheet ejection roller pair 7, which ejects the sheet P onto the output tray 17, outside the housing of the image forming apparatus 100. Specifically, the output tray 17 is disposed atop the housing of the image forming apparatus 100, on which the plurality of sheets P rest one atop another.

The image forming apparatus 100 further includes toner bottles 9Y, 9C, 9M, and 9Bk that respectively contain fresh toner of yellow, cyan, magenta, and black. Each of the toner bottles 9Y, 9C, 9M, and 9Bk is accommodated in a bottle container disposed in an upper portion of the housing of the image forming apparatus 100, below the output tray 17. The toner bottles 9Y, 9C, 9M, and 9Bk are removable from the respective bottle containers.

A toner supply tube is interposed between each of the toner bottles 9Y, 9C, 9M, and 9Bk and the developing devices 40Y, 40C, 40M, and 40Bk. The toner bottles 9Y, 9C, 9M, and 9Bk supply the fresh toner of yellow, cyan, magenta, and black to the developing devices 40Y, 40C, 40M, and 40Bk through the toner supply tubes, respectively.

As described above, the transfer belt cleaner 13 of the transfer device 71 includes the cleaning brush and the cleaning blade that contact the intermediate transfer belt 11.

With the cleaning brush and the cleaning blade, the transfer belt cleaner 13 scrapes foreign substances off, such as residual toner that has failed to be transferred onto the sheet P and therefore remaining on the intermediate transfer belt 11, thereby cleaning the intermediate transfer belt 11. The transfer belt cleaner 13 includes an ejection member to convey and waste the foreign substances such as residual toner removed from the intermediate transfer belt 11.

As illustrated in FIG. 1, the image forming apparatus 100 includes the power supply 80 and a controller 90 in a lower, left portion in the housing of the image forming apparatus 100. The power supply 80 supplies power input from an external source such as an outlet 301 (e.g., an electric socket) to the internal components of the image forming apparatus 100. The controller 90 is operatively connected to and controls the components of the image forming apparatus 100.

The power supply 80 is coupled to a power plug 81 via a power code. The power plug 81 is inserted into the outlet 301 to transmit power to the power supply 80. Inside the power supply 80 is a voltmeter 85 that measures an input voltage that is input from an external source.

Figure 2:
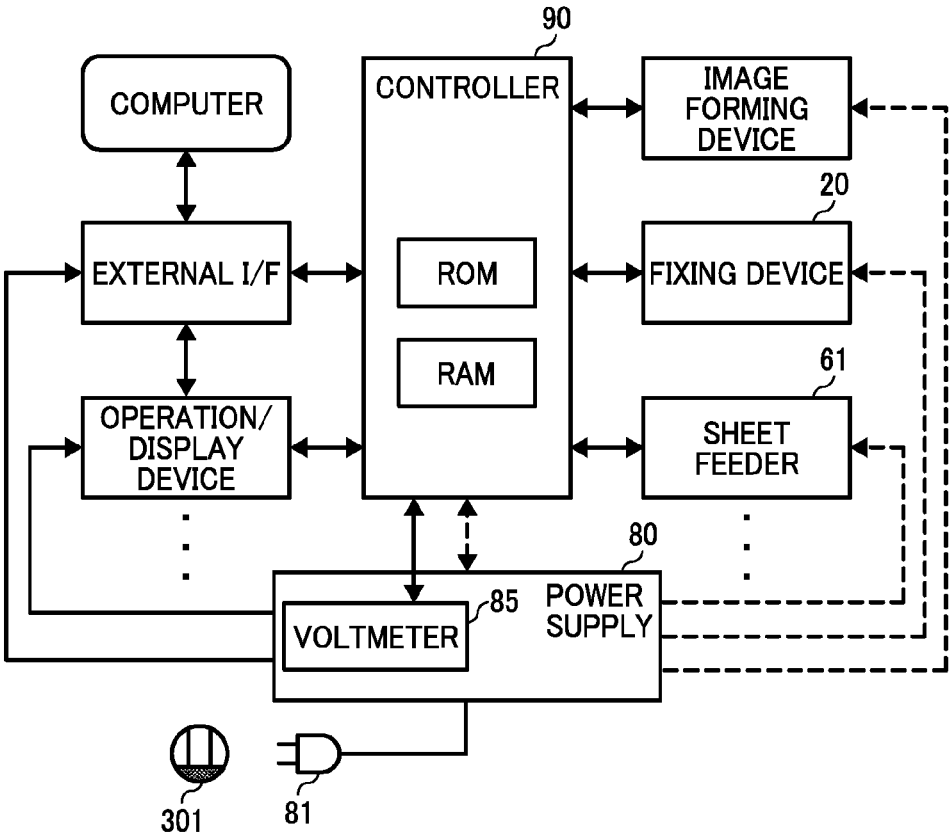
FIG. 2 is a block diagram illustrating an example of a control structure of the image forming apparatus of FIG. 1.

Referring now to FIG. 2, a description is given of a control structure of the image forming apparatus 100.

FIG. 2 is a block diagram illustrating an example of the control structure of the image forming apparatus 100.

The controller 90 is, e.g., a processor of the image forming apparatus 100, and implemented as a central processing unit (CPU) provided with, e.g., a read-only memory (ROM) that stores a control program, a random access memory (RAM) that temporarily stores data, and a nonvolatile flash memory.

For example, the controller 90 executes various types of calculations and drives drivers of the components of the image forming apparatus 100 operatively connected to the controller 90, such as the image forming device, the fixing device 20, the sheet feeder 61, the voltmeter 85, an operation/display device, and an external interface (I/F) that is connected to an external device such as a computer. In addition, the controller 90 communicates with sensors and controls the power supply 80 such that the power supply 80 supplies the components of the image forming apparatus 100 with power input from the outlet 301.

To provide a fuller understanding of embodiments of the present disclosure, a description is now given of an image forming operation of the image forming apparatus 100 with reference to FIG. 1, as executed by the controller 90 described above.

When an image forming operation of the image forming devices starts under control of the controller 90, a driver drives and rotates the photoconductive drums 120Y, 120M, 120C, and 120Bk clockwise in FIG. 1. The chargers 30Y, 30C, 30M, and 30Bk uniformly charge the surface of the photoconductive drums 120Y, 120M, 120C, and 120Bk, respectively, to a predetermined polarity.

The optical writing device 6 irradiates the charged surface of the photoconductive drums 120Y, 120M, 120C, and 120Bk with laser light (i.e., laser beams Lb) according to image data to form electrostatic latent images on the photoconductive drums 120Y, 120M, 120C, and 120Bk. It is to be noted that the image data is single-color image data obtained by separating a desired full-color image into individual color components, that is, yellow, magenta, cyan, and black components.

The developing device 40Y, 40C, 40M, and 40Bk supply the electrostatic latent images formed on the photoconductive drums 120Y, 120M, 120C, and 120Bk with toner of yellow, cyan, magenta, and black, respectively, rendering the electrostatic latent images visible as toner images of yellow, cyan, magenta, and black.

Meanwhile, when the image forming operation starts, the driver drives and rotates the drive roller 72 counterclockwise in FIG. 1 to rotate the intermediate transfer belt 11 in the rotational direction A1. The power supply 80 applies a constant voltage or constant current control voltage having a polarity opposite a polarity of the toner to each of the primary transfer rollers 112Y, 112C, 112M, and 112Bk, producing a predetermined transfer electric field at each of the primary transfer nips formed between the photoconductive drums 120Y, 120C, 120M, and 120Bk and the primary transfer rollers 112Y, 112C, 112M, and 112Bk.

The transfer electric field superimposes the toner images of yellow, cyan, magenta, and black successively onto the intermediate transfer belt 11, thus transferring the toner images of yellow, cyan, magenta, and black from the respective photoconductive drums 120Y, 120M, 120C, and 120Bk onto the intermediate transfer belt 11. Accordingly, a composite, full-color toner image is formed on the outer circumferential surface of the intermediate transfer belt 11.

The cleaner 50Y, 50C, 50M, and 50Bk remove residual toner, which has failed to be transferred onto the intermediate transfer belt 11 and therefore remaining on the surface of the photoconductive drums 120Y, 120M, 120C, and 120Bk, from the surface of the photoconductive drums 120Y, 120M, 120C, and 120Bk, respectively. Thereafter, a discharger removes the charge on each of the surface of the photoconductive drums 120Y, 120M, 120C, and 120Bk to initialize the surface potential thereof.

In the sheet feeder 61 disposed in the lower portion of the image forming apparatus 100, the feed roller 3 starts rotation to feed the sheet P from the sheet tray toward the registration roller pair 4 along the conveyance passage. The activation of the registration roller pair 4 is timed to send the sheet P to the secondary transfer nip formed between the intermediate transfer belt 11 and the secondary transfer roller 5 such that the sheet P meets the full-color toner image formed on the intermediate transfer belt 11 at the secondary transfer nip.

As described above, the secondary transfer roller 5 sandwiches the intermediate transfer belt 11 together with the drive roller 72 as the secondary transfer backup roller, thereby forming the secondary transfer nip between the intermediate transfer belt 11 and the secondary transfer roller 5. The secondary transfer roller 5 is supplied with a transfer voltage having a polarity opposite a polarity of the charged toner contained in the full-color toner image formed on the intermediate transfer belt 11, thereby producing a predetermined transfer electric field at the secondary transfer nip.

When the full-color toner image formed on the intermediate transfer belt 11 reaches the secondary transfer nip in accordance with rotation of the intermediate transfer belt 11, the transfer electric field thus produced at the secondary transfer nip transfers the toner images of yellow, magenta, cyan, and black constructing the full-color toner image from the intermediate transfer belt 11 onto the sheet P collectively.

The transfer belt cleaner 13 removes the residual toner, which has failed to be transferred onto the sheet P and therefore remaining on the intermediate transfer belt 11, from the intermediate transfer belt 11. The removed toner is conveyed and collected into the waste toner container.

The sheet P bearing the full-color toner image is conveyed to the fixing device 20 and fixed onto the sheet P in the fixing device 20. Then, the sheet P bearing the fixed full-color toner image is conveyed to the sheet ejection roller pair 7. The sheet ejection roller pair 7 ejects the sheet P onto the output tray 17 disposed outside the housing of the image forming apparatus 100. Thus, the plurality of sheets P rests on the output tray 17 one atop another.

As described above, the image forming apparatus 100 forms a full-color image on the sheet P. Alternatively, the image forming apparatus 100 may use one of the image forming devices to form a monochrome image, or may use two or three of the image forming devices to form a bicolor or tricolor image, respectively.

As illustrated in FIG. 1, in the present embodiment, the image forming apparatus 100 is a tandem color printer in which the plurality of image forming devices are arranged side by side in the direction in which the intermediate transfer belt 11 is extended, to form different color toner images. Alternatively, however, the image forming apparatus 100 may be a copier, a facsimile machine, or a multifunction peripheral (MFP) having at least one of copying, printing, scanning, facsimile, and plotter functions.

Electrophotographic image forming apparatuses usually output a copied image through a process in which an electrostatic latent image formed on a photoconductor as a latent image bearer is developed with toner as a visible toner image. The toner image is transferred onto a recording medium and fixed onto the recording medium. Thus, a copied image is output.

Currently, there is increased demand for energy-efficient and high-speeding image forming apparatuses such as printers, copiers, facsimile machines, or MFPs.

Typical image forming apparatuses execute an image forming process such as electrophotographic recording, electrostatic recording, or magnetic recording, to form and fix a toner image on a recording medium such as a recording sheet, printing paper, sensitized paper, or dielectric-coated paper, directly or indirectly. Such image forming apparatuses usually incorporate a fixing device to fix the toner image onto the recording medium. Typical fixing methods are, e.g., a thermal-roller fixing method, a belt fixing method, a surface-rapid fusing (SURF) method using a ceramic heater together with a belt or film, and a contact-heating method such as an electromagnetic induction heating method.

Fixing devices employing the belt fixing method may face certain requirements. For example, there is increased demand for shortening a warm-up time and a first print output time.

The warm-up time is a time from a normal temperature, for example, from when the power of the image forming apparatus is turned on, until the fixing device reaches a predetermined temperature (e.g., reload temperature) that allows printing. The first print output time is a time from when printing (i.e., image formation) is requested until when a printed recording medium is output through a printing operation including preparation for printing.

Current high-speeding image forming apparatuses increase the number of recording media conveyed per unit hour and require increased heat, causing a shortage of heat at the beginning of continuous printing in particular, and dropping the temperature.

One approach to addressing this circumstance involves providing a fixing device employing the SURF method using a ceramic heater, which decreases heat capacity and downsizes the fixing device compared to the fixing device employing the belt fixing method. However, as the SURF method heats a localized portion of a fixing rotator (e.g., a fixing belt) in contact with an opposed rotator, the rest of the fixing rotator is not heated. That is, the fixing rotator is coolest before reaching the area of contact with the opposed rotator, where the fixing rotator sandwiches a recording medium with the opposed rotator to fix a toner image onto the recording medium. As a result, a fixing failure may occur.

In particular, a high-speed machine rotates the fixing rotator fast and increases radiation of heat from the fixing rotator other than the localized portion of the fixing rotator in contact with the opposed rotator. Therefore, a fixing failure may frequently occur.

One approach to addressing these circumstances described above involves providing a fixing device incorporating an endless fixing belt and capable of heating an entire circumferential span of fixing belt, shortening the first print output time from a heating standby time, and overcoming the shortage of heat that may occur upon high-speed rotation. The fixing device provides reliable fixability even in an image forming apparatus that provides high productivity.

Figure 3:
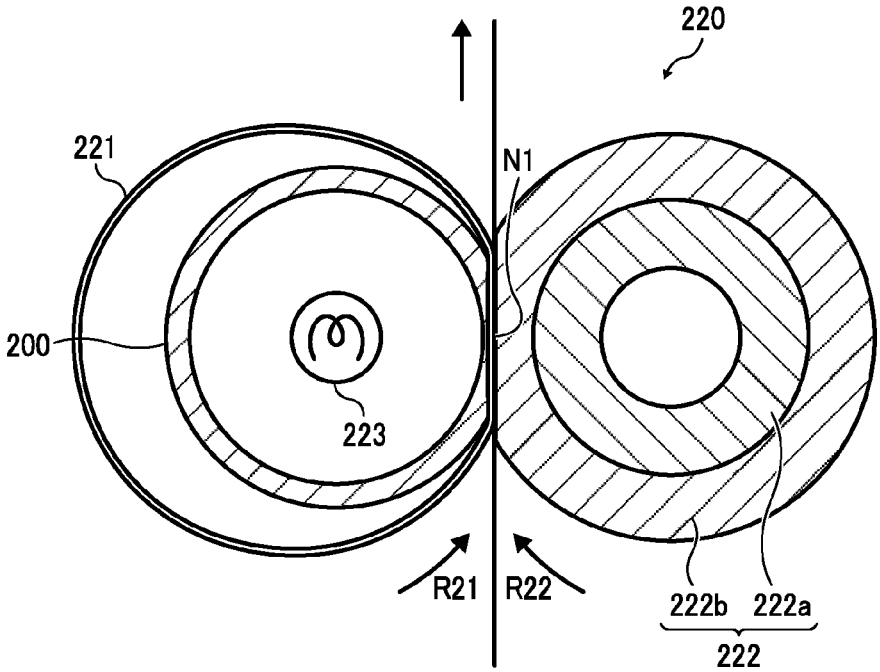
FIG. 3 RELATED ART
FIG. 3 is a schematic cross-sectional view of a comparative fixing device.

FIG. 3 illustrates such a fixing device. Referring now to FIG. 3, a description is given of a comparative fixing device 220.

FIG. 3 is a schematic cross-sectional view of the comparative fixing device 220.

The comparative fixing device 220 includes an endless fixing belt 221 formed into a loop, a metal heat conduction pipe 200 secured inside the loop formed by the fixing belt 221 to guide movement of the fixing belt 221, a heater 223 disposed inside the metal heat conduction pipe 200 to heat the fixing belt 221 via the metal heat conduction pipe 200.

The comparative fixing device 220 further includes a pressure roller 222 that contacts the metal heat conduction pipe 200 via the fixing belt 221 to form an area of contact herein referred to as a fixing nip N1 between the fixing belt 221 and the pressure roller 222. In association with rotation of the pressure roller 222 in a rotational direction R22, the fixing belt 221 rotates in a rotational direction R21. The pressure roller 222 is constructed of a tube 222*a* (e.g., metal tube) and an elastic rubber layer 222*b* coating the tube 222*a*.

With this configuration, the heater 223 heats an entire circumferential span of the fixing belt 221. Accordingly, the comparative fixing device 220 shortens the first print output time from the heating standby time and overcomes the shortage of heat that may occur upon high-speed rotation.

At present, there is increased demand for further shortening the first print output time and enhancing energy efficiency in image forming apparatuses.

One approach to satisfying such demand involves enhancing heat-transfer efficiency. To efficiently transfer heat, image forming apparatuses may incorporate a fixing device that heats a fixing belt directly, instead of a fixing device that heats a fixing belt indirectly via a metal thermal conductor.

Direct heating of the fixing belt significantly enhances heat-transfer efficiency, thereby reducing energy consumption and further shortening the first print output time from the heating standby time.

In other words, the fixing device that heat the fixing belt directly exhibits enhanced energy efficiency and further shortens the first print output time from the heating standby time.

Thus, the fixing devices that directly heat the fixing belt increase heat-transfer efficiency, shortens the first print output time, and are easy to use compared to typical fixing devices. On the other hand, such fixing devices may face unfavorable circumstances.

For example, if printing starts when a relatively low voltage is input to the image forming apparatus, the temperature of the fixing belt may drop and cause an image failure called an offset.

As another example, if an emission length of a heater is different from a recording medium size or width, the recording medium draws heat while passing through the fixing nip on one hand, the temperature increases outside where the recording medium passes on the other hand. Such a localized temperature rise degrades internal components of the fixing device.

To address these circumstances, in the present embodiment, the image forming apparatus 100 incorporates the fixing device 20, of which a plurality of configuration examples are described below.

Figure 4:
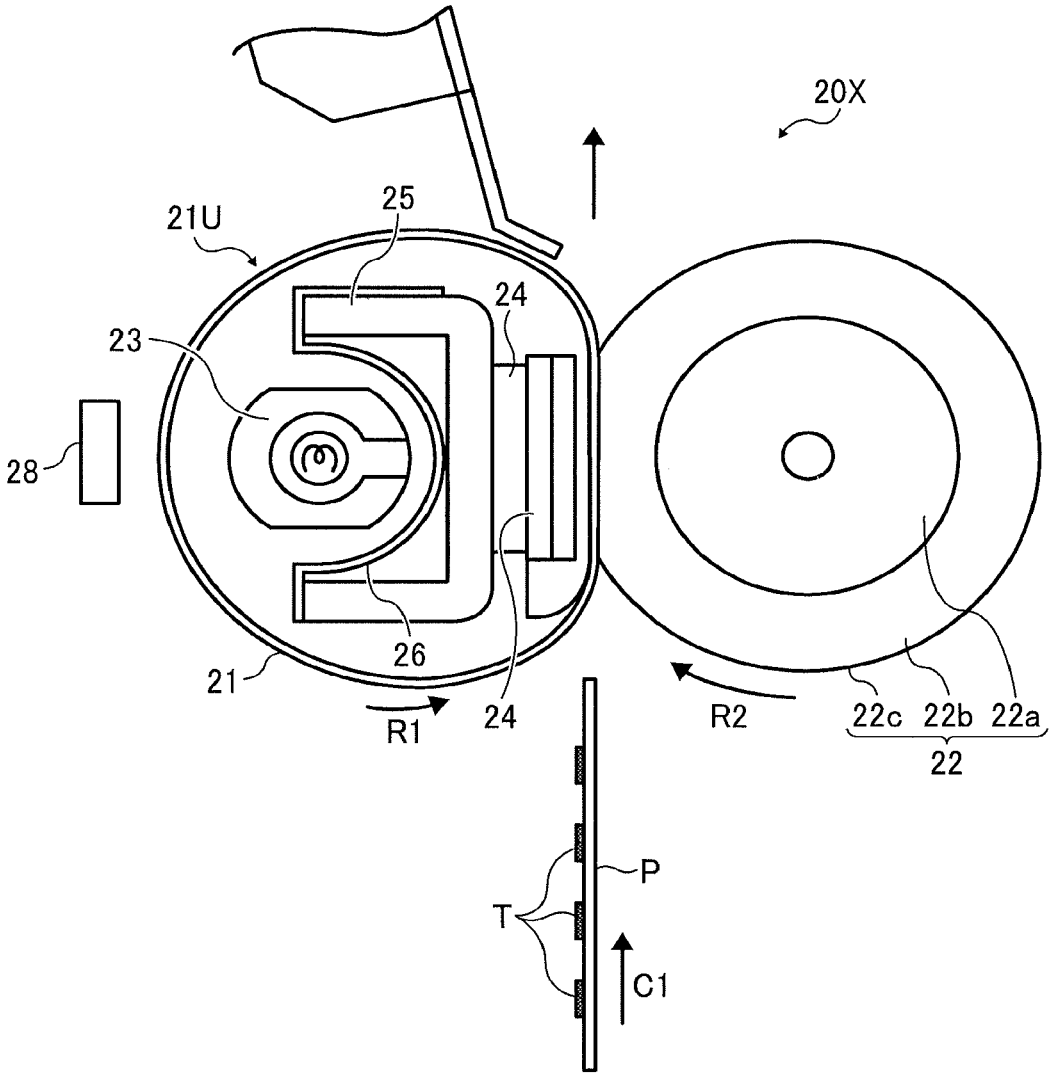
FIG. 4 is a schematic cross-sectional view of a first configuration example of a fixing device incorporated in the image forming apparatus of FIG. 1.

Referring now to FIG. 4, a detailed description is given of a first configuration example of the fixing device 20 incorporated in the image forming apparatus 100 described above.

FIG. 4 is a schematic cross-sectional view of a fixing device 20X as the first configuration example of the fixing device 20.

The fixing device 20X includes, e.g., a fixing belt 21, a pressure roller 22, a heater 23, a nip formation pad 24, a stay 25, a reflector 26, and a temperature sensor 28. The fixing belt 21 is an endless fixing rotator formed into a loop and rotatable in a given direction of rotation, that is, a rotational direction R1 as illustrated in FIG. 4. The fixing belt 21 and the components disposed inside the loop formed by the fixing belt 21, that is, the heater 23, the nip formation pad 24, the stay 25, and the reflector 26, constitute a belt unit 21U detachably coupled to the pressure roller 22. The heater 23 is a halogen heater that radiates heat to directly heat an inner circumferential surface of the fixing belt 21. The nip formation pad 24 is a pressure pad disposed opposite the pressure roller 22 via the fixing belt 21, sandwiching the fixing belt 21 together with the pressure roller 22 to form an area of contact herein referred to as a fixing nip N between the fixing belt 21 and the pressure roller 22. Through the fixing nip N, the sheet P bearing a toner image T is conveyed in the sheet conveyance direction C1. As the fixing belt 21 rotates in the rotational direction R1, the fixing belt 21 slides over the nip formation pad 24 directly, or indirectly via a low-friction sheet. The pressure roller 22 is a pressure rotator disposed opposite the nip formation pad 24 via the fixing belt 21 to press the fixing belt 21 against the nip formation pad 24 to form the fixing nip N between the fixing belt 21 and the pressure roller 22. The pressure roller 22 is rotatable in a given direction of rotation, that is, a rotational direction R2 as illustrated in FIG. 4.

In the present example, the fixing nip N is flat as illustrated in FIG. 4. Alternatively, the fixing device 20X may be configured such that the fixing nip N is given a concave shape or another shape. For example, if the fixing nip N is given a concave shape, the leading end of the sheet P is directed toward the pressure roller 22 as the sheet P is ejected from the fixing nip N, thereby facilitating separation of the sheet P from the fixing belt 21 and preventing a paper jam.

The fixing belt 21 is an endless belt or film made of a metal material, such as nickel or stainless steel (e.g., steel use stainless or SUS), or a resin material such as polyimide. The fixing belt 21 is constructed of a base layer and a release layer. The release layer, as an outer surface layer of the fixing belt 21, is made of tetrafluoroethylene-perfluoroalkyl vinyl ether copolymer (PFA), polytetrafluoroethylene (PTFE), or the like to facilitate separation of toner of the toner image on the sheet P from the fixing belt 21. An elastic layer made of, e.g., silicone rubber may be interposed between the base layer and the release layer.

Omitting the elastic layer reduces heat capacity and facilitates increase in temperature. However, the slight surface roughness of the fixing belt 21 may be transferred onto a recording medium while a toner image is fixed onto the recording medium, causing an orange-peel image, which is an image having uneven gloss in a solid part thereof. To address this circumstance, the elastic layer may be provided with a thickness not smaller than about 100 micrometers. As the elastic layer deforms, the elastic layer absorbs slight surface asperities in the fixing belt 21 to provide improved imaging quality.

The stay 25 is a supporter to support the fixing nip N. The stay 25 prevents bending of the nip formation pad 24 against pressure from the pressure roller 22, and produces an even length of the fixing nip N in the sheet conveyance direction C1 throughout an entire width of the fixing belt 21 in an axial direction thereof. A holder (e.g., a flange) holds each end portion of the stay 25, thus secures the stay 25 at a predetermined position.

The reflector 26 is interposed between the heater 23 and the stay 25. The reflector 26 reflects the heat radiating from the heater 23 toward the inner circumferential surface of the fixing belt 21, thereby preventing the stay 25 from being heated unnecessarily by the heater 23 and suppressing waste of energy.

Alternatively, instead of the reflector 26, the surface of the stay 25 facing the heater 23 may be insulated or given a mirror finish to reflect the heat radiating from the heater 23 toward the fixing belt 21.

In the present example, the heater 23 is a halogen heater. Alternatively, the heater 23 may be an induction heater, a resistance heat generator, a carbon heater, or the like.

The temperature sensor 28 is a temperature detector disposed opposite an outer circumferential surface of the fixing belt 21 to detect a surface temperature of the fixing belt 21. In the present example, the temperature sensor 28 is situated to detect the surface temperature of the fixing belt 21 at a position upstream from the fixing nip N and in a heating region of the heater 23 in the rotational direction R1 of the fixing belt 21.

Based on the temperature detected by the temperature sensor 28, the controller 90 controls a heating operation of the heater 23. In other words, the controller 90 controls the heating operation as appropriate for, e.g., ambient temperature and the type and thickness of the sheet P bearing the toner image T, along with a preliminary heating operation to increase the temperature from a normal temperature to a predetermined temperature suitable for printing.

In the present example, the temperature sensor 28 is a non-contact type, temperature sensor. Alternatively, the fixing device 20X may be configured to include a contact-type temperature sensor as the temperature sensor 28. As illustrated in FIG. 4, the temperature sensor 28 is disposed opposite the heater 23 to detect the surface temperature of the fixing belt 21. Alternatively, the temperature sensor 28 may be disposed at another position depending on the configuration of the fixing device 20. For example, the temperature sensor 28 may be disposed downstream from the fixing nip N in the rotational direction R1 of the fixing belt 21 in a non-heating region of the heater 23 provided that the temperature sensor 28 does not disturb other components of the fixing device 20 and conveyance of the sheet P.

The pressure roller 22 is constructed of a tube 22*a* (e.g., metal tube), an elastic rubber layer 22*b* coating the tube 22*a*, and a release layer 22*c* coating the elastic rubber layer 22*b*. The release layer 22*c* is made of PFA or PTFE to facilitate separation of the sheet P from the pressure roller 22. As a driving force generated by a driver (e.g., a motor) situated inside the image forming apparatus 100 is transmitted to the pressure roller 22 through a gear train, the pressure roller 22 rotates in the rotational direction R2.

As a biasing mechanism such as a spring presses the pressure roller 22 against the fixing belt 21, the elastic rubber layer 22*b* of the pressure roller 22 is deformed, forming an area of contact (e.g., fixing nip N) having a predetermined length in the sheet conveyance direction C1 between the fixing belt 21 and the pressure roller 22.

The pressure roller 22 may be either hollow or solid. If the pressure roller 22 is a hollow roller, optionally a heater such as a halogen heater may be disposed inside the pressure roller 22. The elastic rubber layer 22*b* may be made of solid rubber. Alternatively, if no heater is situated inside the pressure roller 22, the elastic rubber layer 22*b* may be made of sponge rubber. The sponge rubber is preferable to solid rubber because the sponge rubber has enhanced insulation that draws less heat from the fixing belt 21.

As the pressure roller 22 rotates in the rotational direction R2, the fixing belt 21 rotates in the rotational direction R1. In the present example, as the driver generates the driving force and rotates the pressure roller 22 in the rotational direction R2, the driving force is transmitted from the pressure roller 22 to the fixing belt 21 at the fixing nip N, thereby rotating the fixing belt 21 in the rotational direction R1. In short, the pressure roller 22 forms the fixing nip N together with the fixing belt 21 while transmitting the driving force to the fixing belt 21 to rotate the fixing belt 21. At the fixing nip N, the fixing belt 21 rotates while being sandwiched between the pressure roller 22 and the nip formation pad 24. On the other hand, at a circumferential span of the fixing belt 21 other than the fixing nip N, the fixing belt 21 rotates while each end portion of the fixing belt 21 is guided by the holder (e.g., flange).

With such a configuration, the fixing device 20X shortens the warm-up time and decreases production cost.

Figure 5:
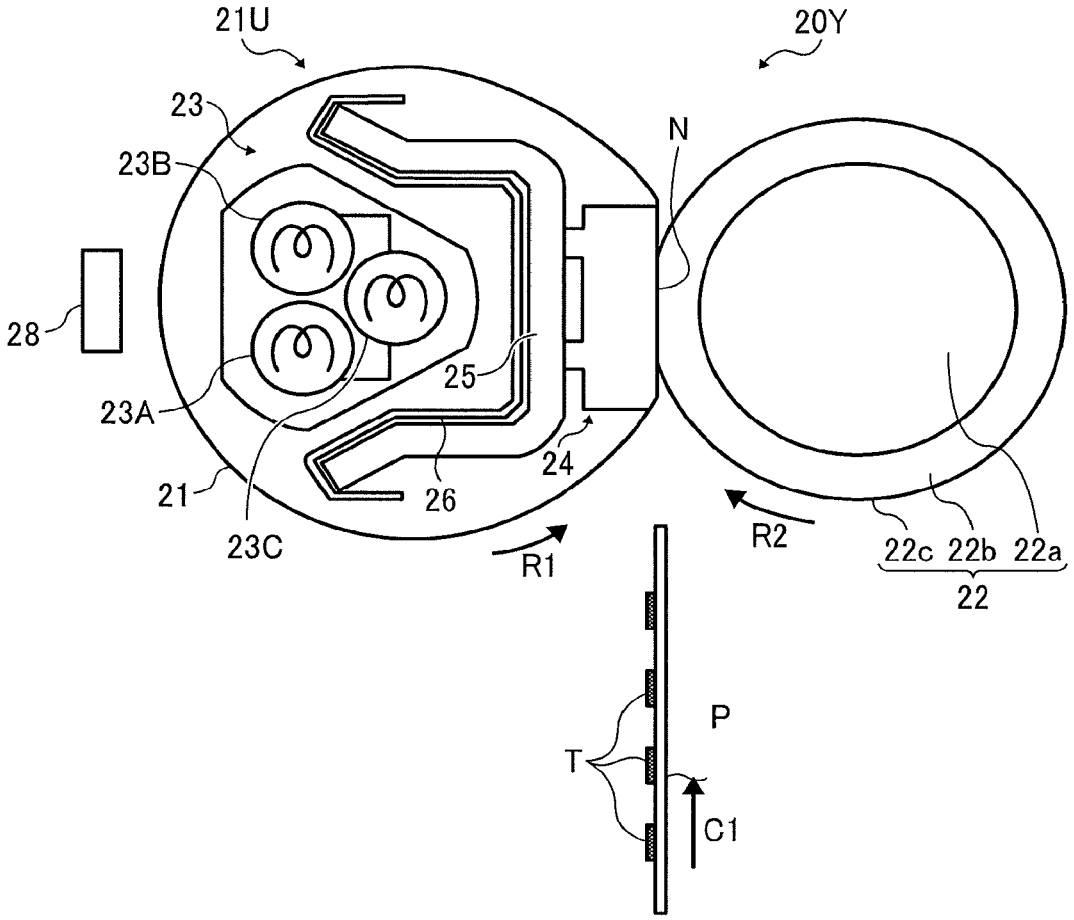
FIG. 5 is a schematic cross-sectional view of a second configuration example of the fixing device incorporated in the image forming apparatus of FIG. 1.

Referring now to FIG. 5, a description is given of a second configuration example of the fixing device 20 incorporated in the image forming apparatus 100 described above.

FIG. 5 is a schematic cross-sectional view of a fixing device 20Y as the second configuration example of the fixing device 20.

Unlike the fixing device 20X that includes one halogen heater as the heater 23, the fixing device 20Y includes three halogen heaters 23A through 23C constructing the heater 23 as illustrated in FIG. 5. In this configuration example, the halogen heaters 23A through 23C are disposed to cover the width of the sheet P conveyed through the fixing device 20Y.

Figure 6A:
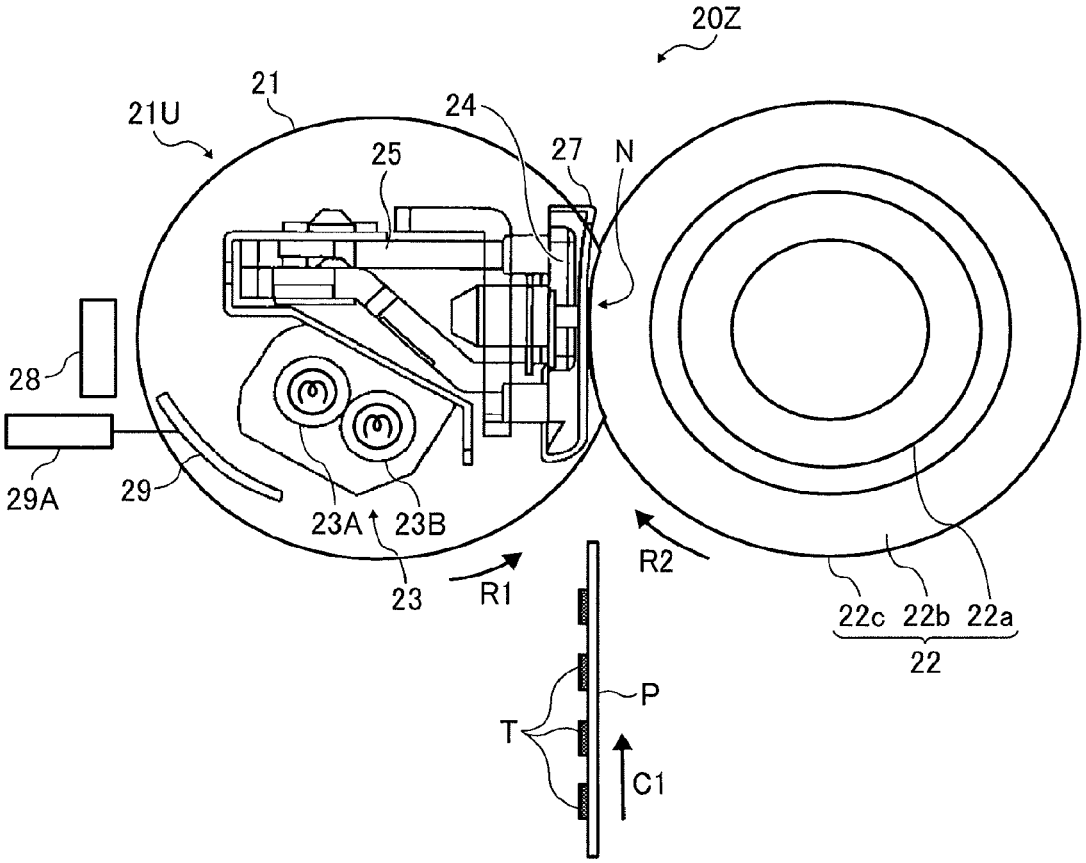
FIG. 6A is a schematic cross-sectional view of a third configuration example of the fixing device incorporated in the image forming apparatus of FIG. 1.
Figure 6B:
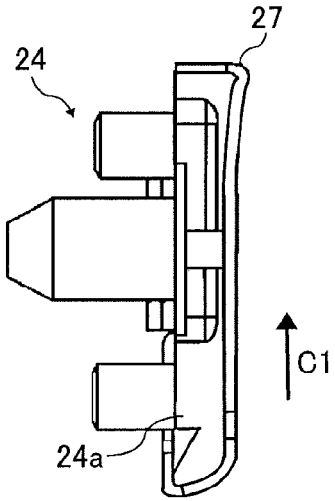
FIG. 6B is a cross-sectional view of a nip formation pad provided with a thermal storage incorporated in the fixing device of FIG. 6A.

Referring now to FIGS. 6A and 6B, a description is given of a third configuration example of the fixing device 20 incorporated in the image forming apparatus 100 described above.

FIG. 6A is a schematic cross-sectional view of a fixing device 20Z as the third configuration example of the fixing device 20. FIG. 6B is a cross-sectional view of the nip formation pad 24 provided with a thermal storage 27 incorporated in the fixing device 20Z.

In this configuration example, the heater 23 is constructed of two halogen heaters 23A and 23B as illustrated in FIG. 6A. However, unlike the first and second configuration examples described above, the fixing device 20Z includes the thermal storage 27 and a heat shield 29. The thermal storage 27 having a high thermal capacity is interposed between the nip formation pad 24 and the fixing belt 21. A detailed description of the thermal storage 27 is deferred. The heat shield 29 (e.g., a heat shield plate) is a shield to shield the fixing belt 21 from light and heat. For example, the heat shield 29 shields the fixing belt 21 from the heat and light radiating from the halogen heaters 23A and 23B.

Specifically, the heat shield 29 has a heat shielding area with a plurality of steps conforming to various sizes or widths of the sheets P that can be conveyed through the fixing device 20Z. The heat shield 29 is disposed inside the loop formed by the fixing belt 21, and is pivotable along the inner circumferential surface of the fixing belt 21 without contacting the fixing belt 21. The heat shield 29 is selectively pivoted to a plurality of shield positions according to the size of the sheet P, shielding the fixing belt 21 from the heater 23 in an axial span of the fixing belt 21 where heating of the fixing belt 21 is unnecessary.

Accordingly, even if a plurality of relatively small or narrow sheets P are conveyed through the fixing device 20Z continuously, a non-conveyance span of the fixing belt 21 where the sheets P are not conveyed does not overheat. Thus, the fixing device 20Z removes needless control, such as degradation of productivity, for eliminating an excessive temperature rise in the non-conveyance span of the fixing belt 21. That is, the fixing device 20Z reduces possibility of thermal degradation of the internal components of the fixing device 20Z.

In this configuration example, the heat shield 29 has an oblique heat shielding edge. When the heat shield 29 is pivoted, the oblique heat shielding edge varies the heat shielding area of the heat shield 29 in a thrust direction in which a thrust is generated, rendering unnecessary to determine the number of the halogen heaters constructing the heater 23 according to the size of the sheet P.

Specifically, in the fixing device 20Z, the heater 23 is constructed of the halogen heaters 23A and 23B that radiate heat to heat the fixing belt 21. The fixing device 20Z includes the temperature sensor 28 that detects the temperature of the fixing belt 21, the heat shield 29 that shields the fixing belt 21 from heat and light radiating from the heater 23, and a drive motor 29A as a driver that moves the heat shield 29 to change the heat shielding area of the heat shield 29.

With such a configuration, the fixing device 20Z has advantages as follows.

That is, even if a plurality of relatively small or narrow sheets P are conveyed through the fixing device 20Z continuously, the non-conveyance span of the fixing belt 21 does not overheat. Thus, the fixing device 20Z removes needless control, such as degradation of productivity, for eliminating an excessive temperature rise in the non-conveyance span of the fixing belt 21. That is, the fixing device 20Z reduces possibility of thermal degradation of the internal components of the fixing device 20Z, without executing needless control, such as degradation of productivity, for eliminating an excessive temperature rise in the non-conveyance span of the fixing belt 21.

As described above, if printing starts when a relatively low voltage is input to image forming apparatuses, the temperature of the fixing belt may drop and cause an image failure.

A voltage lower than a standard voltage may be input to the image forming apparatuses, for example, when an independent power generator is used and the power generator generates insufficient power, when the image forming apparatuses are used in a country where power supply is unstable, or when activation of another electric appliance temporarily decreases the voltage that is input to the image forming apparatus that is connected to an outlet to which the other electric appliance is also connected.

Relatedly, the outlet 301 that supplies power to the power supply 80 of the image forming apparatus 100 is, e.g., an outlet mounted in a wall, floor, ceiling, or the like of a place where the image forming apparatus 100 is installed, an outlet mounted on a power supplier such as a power generator (e.g., an independent power generator), an uninterruptible power supply, a stabilized power supply, and a distribution board, or an outlet extending therefrom.

To address the image failure caused by the temperature drop of the fixing belt, in the present embodiment, the image forming apparatus 100 includes the fixing device 20 that includes the fixing belt 21, the heater 23 capable of heating the fixing belt 21 directly, and the pressure roller 22 that presses the sheet P toward the fixing belt 21.

The fixing belt 21 is, e.g., an endless belt formed into a loop. The fixing device 20 further includes the nip formation pad 24 disposed inside the loop formed by the fixing belt 21. The pressure roller 22 is disposed opposite the nip formation pad 24 via the fixing belt 21, sandwiching the fixing belt 21 together with the nip formation pad 24 to form the fixing nip N between the fixing belt 21 and the pressure roller 22. The pressure roller 22 presses the fixing belt 21 against the nip formation pad 24.

Based on an input voltage that is input to the image forming apparatus 100 from the outlet 301, the controller 90 controls a heating operation of the heater 23 and a fixing operation of the fixing device 20 to fix the toner image T onto the sheet P. For example, based on the input voltage to the image forming apparatus 100 from the outlet 301, the controller 90 controls the heater 23 to heat the fixing belt 21 before conveyance of the sheet P. The controller 90 adjusts the time to convey the sheet P bearing the toner image T through the fixing nip N, or changes a spatial interval between consecutive sheets P conveyed.

With such a configuration, the image forming apparatus 100 has advantages as follows.

For example, if the input voltage is lower than a predetermined reference voltage that allows the heater 23 to heat the fixing belt 21 to a target fixing temperature, start of printing (i.e., image formation) is delayed so that the heater 23 heats the fixing belt 21 to the target fixing temperature before printing starts. It is to be noted that the target fixing temperature herein is a temperature of the fixing belt 21 that allows the toner image T to be fixed onto the sheet P properly. In other words, the target fixing temperature allows a normal fixing operation.

Upon continuous printing, if the input voltage is lower than the reference voltage, the consecutive sheets P subject to printing are conveyed at increased intervals so that the heater 23 heats the fixing belt 21 to the target fixing temperature between the consecutive sheets P conveyed, thereby maintaining the temperature of the fixing belt 21 equal to or higher than a given temperature.

Accordingly, the image forming apparatus 100 prevents an image failure that may be caused by the temperature drop of the fixing belt 21 due to decrease in voltage that is input to the image forming apparatus 100.

To enhance prevention of such an image failure that may be caused by the temperature drop of the fixing belt 21, the fixing device 20 (e.g., fixing device 20Z) further includes the thermal storage 27 between the nip formation pad 24 and the fixing belt 21. The thermal storage 27 is made of a material having a larger thermal capacity than a thermal capacity of a base 24*a* of the nip formation pad 24 illustrated in FIG. 6B.

With such a configuration, the image forming apparatus 100 has advantages as follows.

Even when the input voltage slightly varies, the thermal storage 27 stores heat generated by the heater 23 and supplies the fixing belt 21 with the heat thus stored. With the fixing device 20 incorporating the thermal storage 27, the image forming apparatus 100 enhances prevention of an image failure that may be caused by the temperature drop of the fixing belt 21 due to decrease in voltage that is input to the image forming apparatus 100, compared to typical image forming apparatuses that incorporate a fixing device without a thermal storage.

For example, if the input voltage is lower than the reference voltage that allows the heater 23 to heat the fixing belt 21 to the target fixing temperature, start of printing (i.e., image formation) is delayed so that the thermal storage 27 stores heat generated by the heater 23 before printing starts and that the thermal storage 27 supplies the heat thus stored to the fixing belt 21 after printing starts.

Upon continuous printing, if the input voltage is lower than the reference voltage, the consecutive sheets P subject to printing are conveyed at increased intervals so that the heater 23 supplies heat to the thermal storage 27. As a consequence, the thermal storage 27 maintains a given amount of heat while the fixing belt 21 remains at a given temperature or higher.

As the thermal storage 27 is interposed between the nip formation pad 24 and the fixing belt 21, the thermal storage 27 efficiently stores the heat generated by the heater 23 and transmits the heat thus stored to the fixing belt 21 having a decreased temperature.

Referring now to FIGS. 6A through 8, a detailed description is given of the fixing device 20Z.

Figure 7:
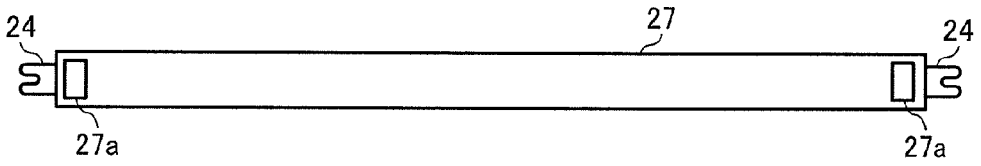
FIG. 7 is a plan view of the thermal storage mounted on the nip forming pad, as seen from a fixing belt side.
Figure 8:
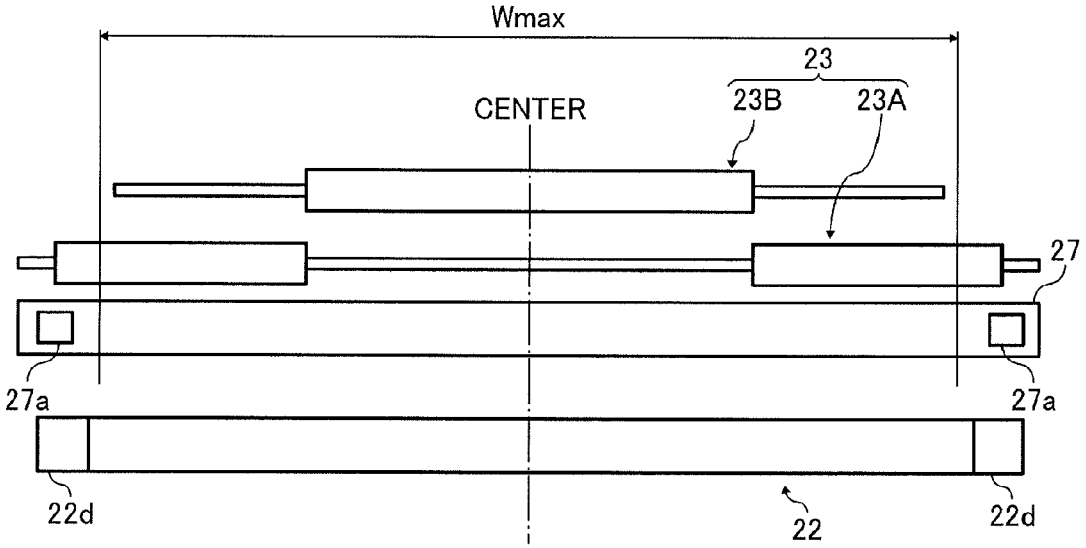
FIG. 8 is an exploded view of a heater, the thermal storage, and a pressure roller incorporated in the fixing device of FIG. 6A, illustrating relative positions thereof in a width direction of a recording medium conveyed through the fixing device of FIG. 6A.

FIG. 7 is a plan view of the thermal storage 27 mounted on the nip forming pad 24, as seen from a fixing belt (i.e., fixing belt 21) side. FIG. 8 is an exploded view of the heater 23, the thermal storage 27, and a pressure roller 22 incorporated in the fixing device 20Z, illustrating relative positions thereof in a width direction of the sheet P perpendicular to the rotational direction A1 of the fixing belt 21.

As illustrated in FIGS. 6A and 6B, the thermal storage 27 is made of metal and extends in the width direction of the sheet P between the nip formation pad 24 and the fixing belt 21. That is, a longitudinal direction of the thermal storage 27 is parallel to the width direction of the sheet P. For example, the thermal storage 27 is made of an inexpensive metal material having enhanced thermal conductivity such as copper, aluminum, or nickel. As described above, the thermal storage 27 has a larger thermal capacity than the thermal capacity of the base 24*a* of the nip formation pad 24 illustrated in FIG. 6B.

In this example, a low-friction sheet is not disposed on the thermal storage 27 mounted on the nip forming pad 24. More specifically, the low-friction sheet is not disposed on a slide surface of the thermal storage 27 over which the fixing belt 21 slides, so as to enhance absorption of heat from the fixing belt 21. However, if the thermal storage 27 absorbs excessive heat from the fixing belt 21 or if the fixing belt 21 has an insufficient torque, the low-friction sheet may be disposed on the slide surface of the thermal storage 27. Alternatively, the slide surface of the thermal storage 27 may be coated to enhance slidability of the fixing belt 21 and prevent attrition of the inner circumferential surface of the fixing belt 21.

Alternatively, grease may be applied to the slide surface of the thermal storage 27 to enhance the slidability of the fixing belt 21. Preferably, a high thermal conductive grease having enhanced thermal conductivity may be used to enhance heat conduction. For example, the thermal conductive grease may be a silicon grease or a silicon grease including high thermal conductive particles such as zinc oxide.

In this example, as illustrated in FIG. 7, the thermal storage 27 includes slots 27*a* on opposed end portions thereof. The slots 27*a* prevent radiation of heat from the opposed end portions of the thermal storage 27 in the longitudinal direction thereof. Alternatively, the thermal storage 27 may not include the slots 27*a*, depending on the configuration of the fixing device 20.

In the fixing device 20Z, the fixing belt 21, the nip formation pad 24, and the pressure roller 22 have substantially identical lengths in the width direction of the sheet P axially along the fixing belt 21 and the pressure roller 22.

As illustrated in FIG. 8, symmetrical high adhesive portions 22*d* having a relatively high adhesiveness are formed at opposed end portions of the pressure roller 22, outside a maximum conveyance span Wmax defining a maximum conveyable size of the sheet P. The high adhesive portions 22*d* effectively transmit a torque of the pressure roller 22 to the fixing belt 21.

The thermal storage 27, mounted on the base 24*a* of the nip formation pad 24 between the base 24*a* and the fixing belt 21, has a length in the width direction of the sheet P such that a spatial interval between inner ends of the slots 27*a* on the opposed end portions of the thermal storage 27 is slightly longer than a spatial interval between the high adhesive portions 22*d* formed on the opposed end portions of the pressure roller 22.

The heater 23 is constructed of the heater 23A that heats a center portion of the fixing belt 21 and the heater 23B that heats opposed end portions of the fixing belt 21. The heater 23 substantially covers the maximum conveyance span Wmax, suppressing heat storage in the non-conveyance span of the fixing belt 21, thereby preventing an excessive temperature rise of the fixing belt 21.

To reduce thermal capacity, the fixing device 20Z incorporates an endless, thin film as the fixing belt 21. Generally, for a stable rotation of such a thin film at a fixing nip (e.g., fixing nip N), a driving force is reliably transmitted to the thin film form an opposed roller (e.g., pressure roller 22) that contacts an outer circumferential surface of the thin film.

To reliably transmit the driving force to the thin film, the surface of the opposed roller preferably has a relatively high skid resistance. However, such a relatively high skid resistance increases surface adhesiveness. As a consequence, residual toner that has failed to be fixed onto a recording medium (e.g., sheet P) and transferred onto the outer circumferential surface of the thin film from the recording medium might adhere to the surface of the opposed roller and contaminate the backside of the following recording medium passing between the thin film and the opposed roller.

To address this circumstance, in the fixing device 20Z, the pressure roller 22 has a center portion, where the sheet P bearing the toner image T is conveyed, coated by a relatively low adhesive material such as a PFA tube, thereby preventing adhesion of toner from the toner image T to the surface of the pressure roller 22 when the toner image T is fixed onto the sheet P. On the other hand, e.g., solid rubber is exposed at the opposed end portions (i.e., the high adhesive portions 22*d*) of the pressure roller 22 to increase adhesiveness at the opposed end portions of the pressure roller 22. The high adhesive portions 22*d* provided at the opposed end portions of the pressure roller 22 supplement the driving force reduced at the center portion of the pressure roller 22 to reliably transmit the driving force from the pressure roller 22 to the fixing belt 21.

Generally, if solid rubber is used to form such a high adhesive portion, the temperature of the high adhesive portion is to be increased to some extent to obtain viscosity of rubber. In a fixing device incorporating a heater that directly heats a fixing belt, the high adhesive portion might be exposed to high temperature for a long period of time.

If the solid rubber is exposed to high temperature for a long period of time, the solid rubber may be harden and decreases adhesiveness. As a consequence, the solid rubber may crack. That is, although the high adhesive portion of the opposed roller (e.g., pressure roller 22) is to be heated to some extent, excessive heating of the high adhesive portion may cause a failure.

Hence, in the fixing device 20Z, the metal thermal storage 27 is interposed between the nip formation pad 24 and the fixing belt 21 so as to face the high adhesive portions 22*d* of the pressure roller 22, so that heat is supplied to the thermal storage 27 from the fixing belt 21 before the heat is supplied to the high adhesive portions 22*d*.

Such a configuration prevents excessive supply of heat generated by the heater 23 to the high adhesive portions 22*d* of the pressure roller 22 from the fixing belt 21, increasing the temperature of the high adhesive portions 22*d* of the pressure roller 22 as appropriate.

As described above, the image forming apparatus 100 includes the voltmeter 85 in the power supply 80 to measure an input voltage that is input from the outlet 301. Based on the input voltage measured by the voltmeter 85, the controller 90 controls the image forming operation to form the toner image T on the sheet P and the fixing operation to fix the toner image T onto the sheet P.

With such control, the image forming apparatus 100 has advantages as follows.

For example, if the input voltage is lower than a predetermined reference voltage that allows the heater 23 to heat the fixing belt 21 to a target fixing temperature, start of printing (i.e., image formation) is delayed so that the heater 23 heats the fixing belt 21 to the target fixing temperature before printing starts. It is to be noted that the target fixing temperature herein is a temperature of the fixing belt 21 that allows the toner image T to be fixed onto the sheet P properly. In other words, the target fixing temperature allows a normal fixing operation.

Upon continuous printing, if the input voltage is lower than the reference voltage, consecutive sheets P are conveyed at increased intervals so that the heater 23 heats the fixing belt 21 to the target fixing temperature between the consecutive sheets P conveyed, thereby maintaining the temperature of the fixing belt 21 equal to or higher than a given temperature.

Accordingly, the image forming apparatus 100 prevents an image failure that may be caused by the temperature drop of the fixing belt 21 due to decrease in voltage that is input to the image forming apparatus 100.

Referring now to FIGS. 9 through 14B, a detailed description is given of a plurality of operation controls executed by the controller 90 of the image forming apparatus 100. The operation controls include control of the fixing operation of the fixing device 20 and the relative printing operation (i.e., image forming operation).

Figure 9:
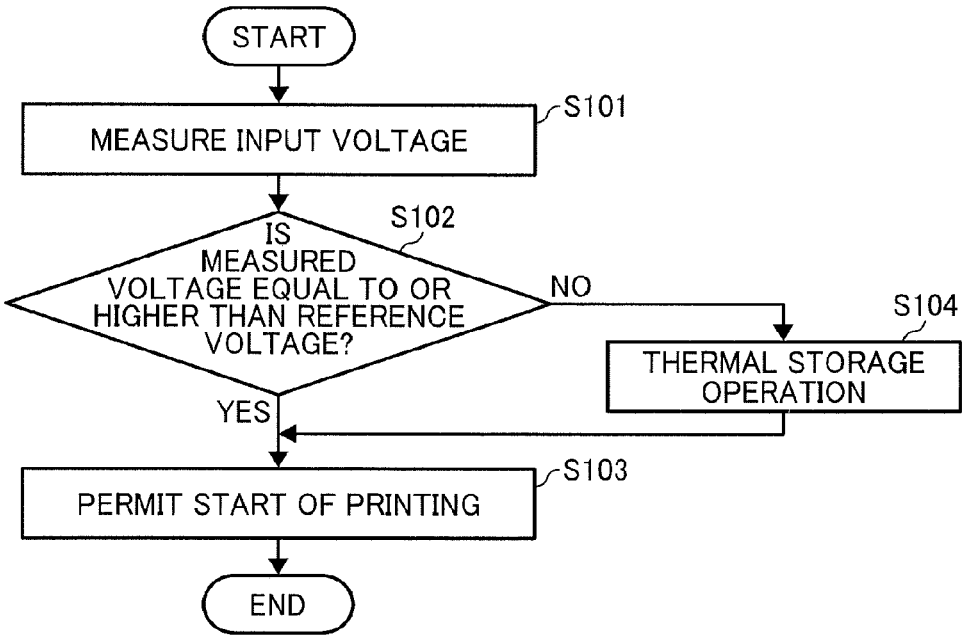
FIG. 9 is a flowchart of a first example of operation control executed by a controller of the image forming apparatus of FIG. 1.

Initially with FIG. 9, a description is given of a first example of the operation control executed by the controller 90 of the image forming apparatus 100.

FIG. 9 is a flowchart of the first example of the operation control.

In the first control example, if a measured input voltage (i.e., input voltage measured by the voltmeter 85) is lower than the predetermined reference voltage, start of the printing operation is delayed compared to when a "normal voltage" equal to or higher than the reference voltage is input. After the thermal storage 27 stores heat, the printing operation starts. In other words, if the input voltage is lower than the reference voltage, a thermal storage operation is executed before image formation. The thermal storage operation includes actuation of the heater 23, rotation of the pressure roller 22, and storing heat generated by the heater 23 in the thermal storage 27.

The first control example illustrated in FIG. 9 starts with receiving a request for start of printing from the operation/display device of the image forming apparatus 100 or an external device such as a computer. When the controller 90 receives the request, the voltmeter 85 of the power supply 80 measures an input voltage that is input from the outlet 301 via the power plug 81 and the power code in step S101.

Subsequently in step S102, the controller 90 determines whether the input voltage measured by the voltmeter 85 (hereinafter simply referred to as measured voltage) is equal to or higher than the predetermined reference voltage. If the controller 90 determines that the measured voltage is equal to or higher than the reference voltage (Yes in S102), then the controller 90 permits start of printing in step S103 and starts control relative to a regular printing operation.

By contrast, if the controller 90 determines that the measured voltage is not equal to or higher than the reference voltage, that is, the measured voltage is lower than the reference voltage (No in S102), then the heater 23 starts heating while the pressure roller 22 starts rotation to rotate the fixing belt 21 in the fixing device 20. The heat generated by the heater 23 is transmitted to the thermal storage 27 via the fixing belt 21 rotating in association with the pressure roller 22 and the nip formation pad 24, and stored in the thermal storage 27. In short, the thermal storage operation is executed in step S104.

The thermal storage operation is continued for a given period of time or until the surface temperature of the fixing belt 21 increases to a given temperature. Then, the controller 90 permits start of printing in step S103 and starts control relative to the regular printing operation.

According to the first control example, the controller 90 controls the components of the image forming apparatus 100 as follows. If the measured voltage is lower than the predetermined reference voltage, the controller 90 delays start of the printing operation compared to when the normal voltage equal to or higher than the reference voltage is input. After the thermal storage 27 stores heat, the controller 90 permits the printing operation to start.

With such control, the image forming apparatus 100 has advantages as follows.

If the input voltage is lower than the reference voltage that allows the heater 23 to heat the fixing belt 21 to the target fixing temperature, the controller 90 delays start of the printing operation so that the thermal storage 27 stores heat generated by the heater 23 before the printing operation starts and that the thermal storage 27 supplies the heat thus stored to the fixing belt 21 after the printing operation starts.

Accordingly, the image forming apparatus 100 prevents an image failure that may be caused by the temperature drop of the fixing belt 21 due to decrease in voltage that is input to the image forming apparatus 100.

Figure 10:
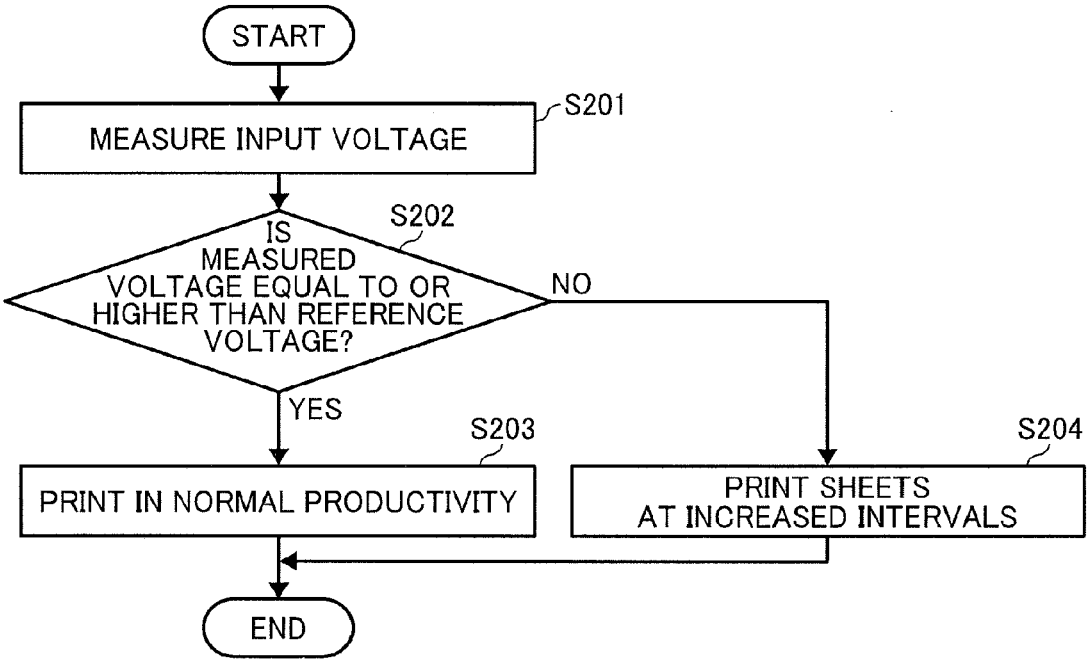
FIG. 10 is a flowchart of a second example of the operation control executed by the controller of the image forming apparatus of FIG. 1.

Referring now to FIG. 10, a description is given of a second example of the operation control executed by the controller 90 of the image forming apparatus 100.

FIG. 10 is a flowchart of the second example of the operation control.

According to the first control example described above, the thermal storage 27 stores heat before conveyance of the sheet P through the fixing device 20 when the input voltage is lower than the reference voltage. However, if the heat stored in the thermal storage 27 is used up after printing starts, the image failure may be caused by the temperature drop of the fixing belt 21 due to decrease in voltage that is input to the image forming apparatus 100.

Hence, in the second control example, consecutive sheets P are conveyed at increased intervals after printing starts if the input voltage is lower than the reference voltage.

The second control example illustrated in FIG. 10 starts with receiving a request for start of continuous printing. When the controller 90 receives the request, the voltmeter 85 of the power supply 80 measures an input voltage that is input from the outlet 301 via the power plug 81 and the power code in step S201.

Subsequently in step S202, the controller 90 determines whether the measured voltage is equal to or higher than the predetermined reference voltage.

If the controller 90 determines that the measured voltage is equal to or higher than the reference voltage (Yes in S202), then the controller 90 starts control relative to the printing operation in normal productivity in step S203.

By contrast, if the controller 90 determines that the measured voltage is not equal to or higher than the reference voltage, that is, the measured voltage is lower than the reference voltage (No in S202), then the printing operation starts, conveying the sheets P at increased intervals in step S204. That is, the printing operation starts in decreased productivity in step S204.

According to the second control example, the controller 90 controls the components of the image forming apparatus 100 as follows. If the measured voltage is lower than the predetermined reference voltage, the controller 90 controls the continuous printing operation to convey the sheets P at increased intervals, compared to when the normal voltage equal to or higher than the reference voltage is input.

With such control, the image forming apparatus 100 has advantages as follows.

If the input voltage is lower than the reference voltage, the consecutive sheets P are conveyed at increased intervals so that the thermal storage 27 stores heat between the sheets P conveyed through the fixing device 20. As a consequence, the thermal storage 27 maintains a given amount of heat while the fixing belt 21 remains at a given temperature or higher.

Accordingly, the image forming apparatus 100 prevents an image failure that may be caused by the temperature drop of the fixing belt 21 due to decrease in voltage that is input to the image forming apparatus 100.

Figure 11:
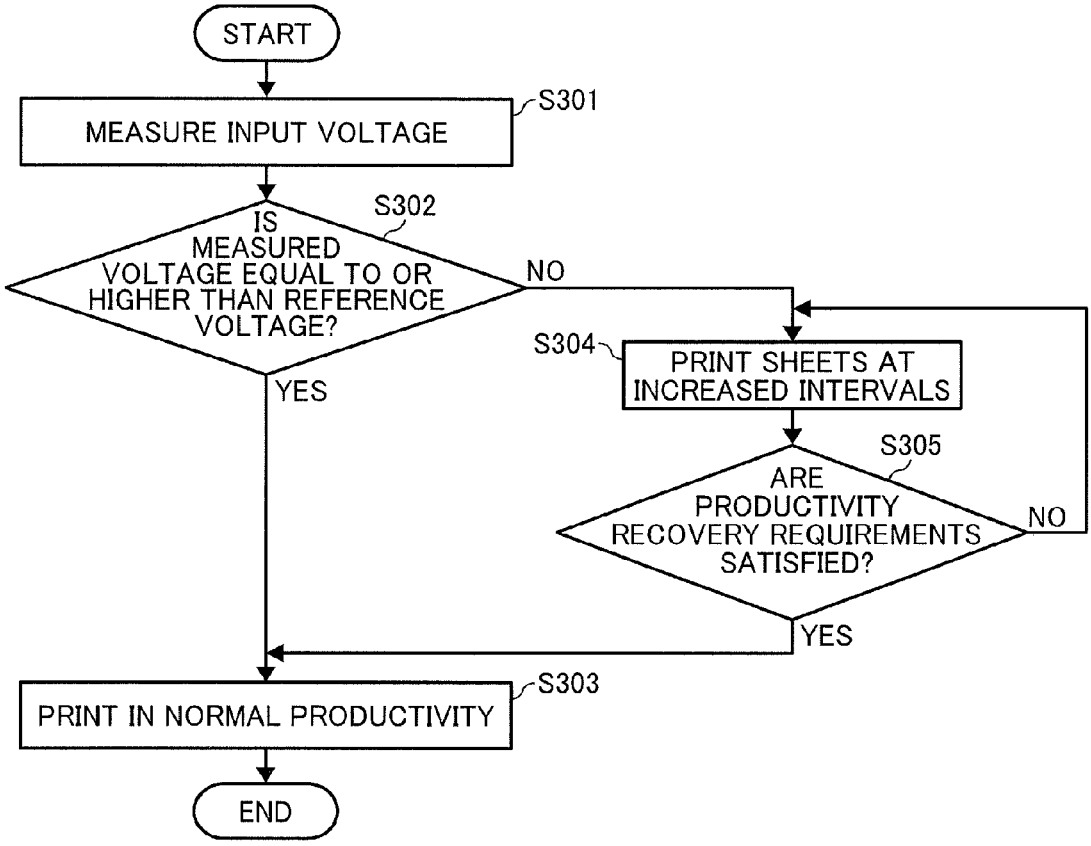
FIG. 11 is a flowchart of a third example of the operation control executed by the controller of the image forming apparatus of FIG. 1.

Referring now to FIG. 11, a description is given of a third example of the operation control executed by the controller 90 of the image forming apparatus 100.

FIG. 11 is a flowchart of the third example of the operation control.

According to the second control example described above, even when the input voltage is lower than the reference voltage, the temperature of the thermal storage 27 may increase to a sufficient temperature during continuous printing of the sheets P that are conveyed at increased intervals.

Hence, in the third control example, if the input voltage is lower than the reference voltage and if predetermined productivity recovery requirements are satisfied during continuous printing of the sheets P that are conveyed at increased intervals, then a spatial interval between the sheets P is returned to a regular spatial interval.

The third control example illustrated in FIG. 11 starts with receiving the request for start of continuous printing. When the controller 90 receives the request, the voltmeter 85 of the power supply 80 measures an input voltage that is input from the outlet 301 via the power plug 81 and the power code in step S301.

Subsequently in step S302, the controller 90 determines whether the measured voltage is equal to or higher than the predetermined reference voltage.

If the controller 90 determines that the measured voltage is equal to or higher than the reference voltage (Yes in S302), then the controller 90 starts control relative to the printing operation in normal productivity in step S303.

By contrast, if the controller 90 determines that the measured voltage is not equal to or higher than the reference voltage, that is, the measured voltage is lower than the reference voltage (No in S302), then the printing operation starts, conveying the sheets P at increased intervals (i.e., in decreased productivity) in step S304.

Subsequently in step S305, the controller 90 determines whether the predetermined productivity recovery requirements are satisfied. The productivity recovery requirements are specified by, e.g., the size and number of the sheets P subjected to printing and the printing duration. If the controller 90 determines that the productivity recovery requirements are satisfied (Yes in S305), then the controller 90 starts control relative to the printing operation in normal productivity in step S303. By contrast, if the controller 90 determines that the productivity recovery requirements are not satisfied (No in S305), then the printing operation continues while conveying the sheets P at increased intervals in S304. The controller 90 repeats determination of whether the productivity recovery requirements are satisfied (in S305) at regular intervals until printing is completed.

According to the third control example, the controller 90 controls the components of the image forming apparatus 100 as follows.

If the measured voltage is lower than the predetermined reference voltage and if the predetermined productivity recovery requirements are satisfied after a continuous printing operation starts, conveying the sheets P at increased intervals, then the spatial interval between the sheets P is returned to the regular spatial interval at which the sheets P are conveyed when the normal voltage is input.

With such control, the image forming apparatus 100 has advantages as follows.

When the printing operation starts, conveying the sheets P at increased intervals, and when the temperature of the thermal storage 27 increases to the sufficient temperature, the spatial interval between the sheets P is returned to the regular spatial interval at which the sheets P are conveyed when the normal voltage is input, thereby enhancing usability of the image forming apparatus 100. In particular, when narrower sheets P are conveyed, heat is continuously supplied to a non-conveyance span of the thermal storage 27 where the sheets P are not conveyed. That is, the temperature of the thermal storage 27 is likely to increase, allowing the spatial interval between the sheets P to be returned to the regular spatial interval earlier than when wider sheets P are conveyed.

Accordingly, the image forming apparatus 100 prevents an image failure that may be caused by the temperature drop of the fixing belt 21 due to decrease in voltage that is input to the image forming apparatus 100, and further prevents decrease in productivity.

Figure 12:
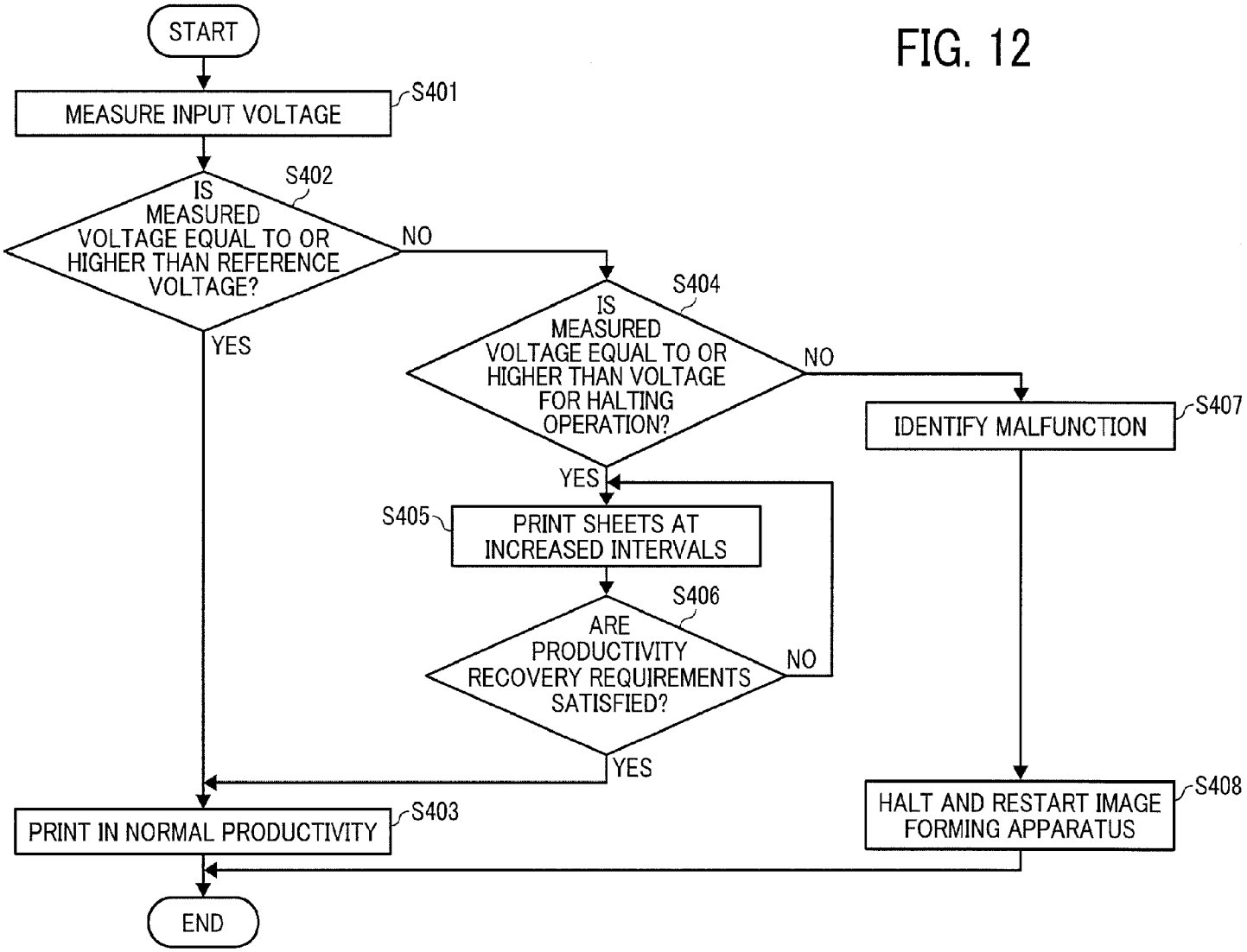
FIG. 12 is a flowchart of a fourth example of the operation control executed by the controller of the image forming apparatus of FIG. 1.

Referring now to FIG. 12, a description is given of a fourth example of the operation control executed by the controller 90 of the image forming apparatus 100.

FIG. 12 is a flowchart of the fourth example of the operation control.

If the input voltage is too low, the first through third control example described above might cause the temperature drop of the fixing belt 21 due to decrease in voltage input to the image forming apparatus 100, resulting in an image failure.

Hence, in the fourth control example, a plurality of levels of the input voltage is predetermined so that the controller 90 identifies which level the measured voltage corresponds to. Based on the level thus identified, the controller determines whether to execute the printing operation, that is, the image forming operation to form the toner image T on the sheet P and the fixing operation including the thermal storage operation before image formation described above in the first control example, or halt and restart the image forming apparatus 100.

Although this procedure can be applied to the first through third control examples described above, a description is now given of an example of applying this procedure to the third control example.

The number of levels of the input voltage can be determined as desired. In the present example, the input voltage is divided into three levels by two threshold voltages including the predetermined reference voltage, namely, the reference voltage (threshold voltage 1) and a voltage for stopping operation (threshold voltage 2). Specifically, the three levels include: a first level equal to or higher than the reference voltage (normal voltage); a second level lower than the reference voltage and equal to or higher than the voltage for stopping operation; and a third level lower than the voltage for stopping operation.

The voltage for stopping operation is predetermined as a lower limit of input voltage that allows a normal fixing operation during continuous printing of the sheets P that are conveyed at increased intervals. In short, the voltage for stopping operation corresponds to a voltage for determining whether operation of the image forming apparatus 100 can be executed.

The fourth control example illustrated in FIG. 12 starts with receiving the request for start of continuous printing. When the controller 90 receives the request, the voltmeter 85 of the power supply 80 measures an input voltage that is input from the outlet 301 via the power plug 81 and the power code in step S401.

Subsequently in step S402, the controller 90 determines whether the measured voltage is equal to or higher than the predetermined reference voltage.

If the controller 90 determines that the measured voltage is equal to or higher than the reference voltage (Yes in S402), then the controller 90 starts control relative to the printing operation in normal productivity in step S403.

By contrast, if the controller 90 determines that the measured voltage is not equal to or higher than the reference voltage, that is, the measured voltage is lower than the reference voltage (No in S402), then the controller 90 determines whether the measured voltage is equal to or higher than the voltage for stopping operation in step S404.

If the controller 90 determines that the measured voltage is equal to or higher than the voltage for stopping operation (Yes in S404), then the printing operation starts, conveying the sheets P at increased intervals in step S405. Subsequently in step S406, the controller 90 determines whether the predetermined productivity recovery requirements are satisfied.

If the controller 90 determines that the productivity recovery requirements are satisfied (Yes in S406), then the controller 90 starts control relative to the printing operation in normal productivity in step S403. By contrast, if the controller 90 determines that the productivity recovery requirements are not satisfied (No in S406), then the printing operation continues while conveying the sheets P at increased intervals in S405. The controller 90 repeats determination of whether the productivity recovery requirements are satisfied (in S406) at regular intervals until printing is completed.

If the controller 90 determines that the measured voltage is not equal to or higher than the voltage for stopping operation (No in S404), then the controller 90 identifies malfunction in step S407. Subsequently in step S408, the controller 90 halts the operation of the image forming apparatus 100 and restarts the image forming apparatus 100.

According to the fourth control example, the controller 90 controls the components of the image forming apparatus 100 as follows in addition to the third control example.

A plurality of threshold voltages are predetermined including the predetermined reference voltage, namely, the reference voltage (threshold voltage 1) and the voltage for stopping operation (threshold voltage 2). The input voltage is divided into three levels by the plurality of threshold voltages as follows: the first level equal to or higher than the reference voltage (normal voltage); the second level lower than the reference voltage and equal to or higher than the voltage for stopping operation; and the third level lower than the voltage for stopping operation. The controller 90 identifies which level the measured voltage corresponds to. Based on the level thus identified, the controller 90 selects execution of the printing operation (i.e., the image forming operation and the fixing operation) described above in the third control example, or restart of the image forming apparatus 100.

With such control, the image forming apparatus 100 has advantages as follows.

Avoiding needless control efficiently prevents an image failure that may be caused by the temperature drop of the fixing belt 21 due to decrease in voltage input to the image forming apparatus 100.

In addition, recovery of the input voltage is confirmed while the image forming apparatus 100 is restarted. In short, restarting the image forming apparatus 100 allows re-measurement of the input voltage.

Figure 13:
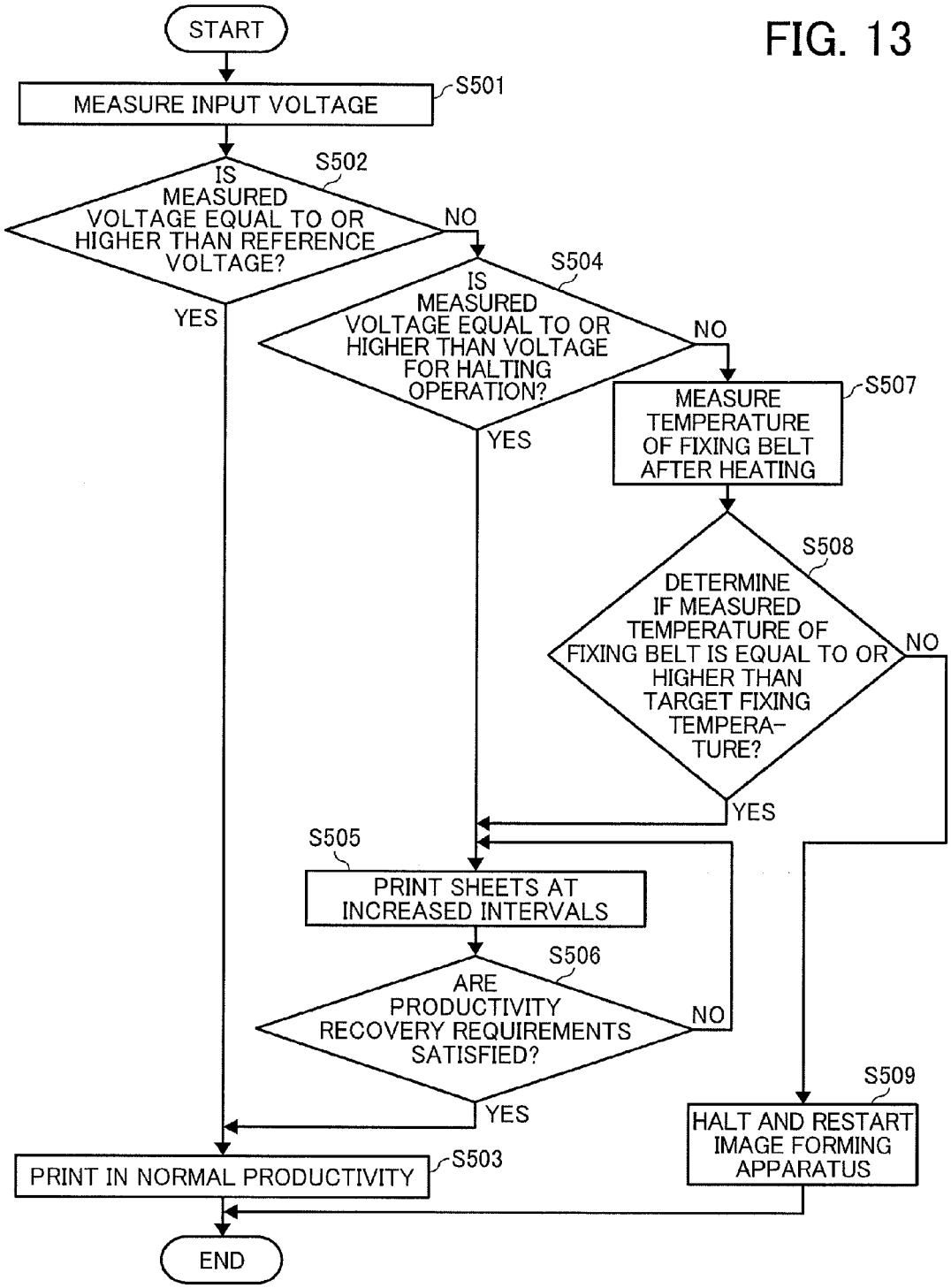
FIG. 13 is a flowchart of a fifth example of the operation control executed by the controller of the image forming apparatus of FIG. 1.

Referring now to FIG. 13, a description is given of a fifth example of the operation control executed by the controller 90 of the image forming apparatus 100.

FIG. 13 is a flowchart of the fifth example of the operation control.

According to the fourth control example described above, the image forming apparatus 100 is restarted if the input voltage is lower than the voltage for stopping operation. However, e.g., upon recovery from a power failure, the input voltage that is input from the outlet 301 might be only temporarily lower than the voltage for stopping operation, in which case operation optimally ought to be stopped only temporarily as well.

Hence, in the fifth control example, if the input voltage is lower than the voltage for stopping operation, the temperature sensor 28 detects or measures the temperature of the fixing belt 21 after the heater 23 executes a predetermined heating operation, so that the controller 90 determines whether the normal fixing operation can be executed with the temperature of the fixing belt 21 measured by the temperature sensor 28 (hereinafter simply referred to as measured temperature of the fixing belt 21).

If the controller 90 determines that the normal fixing operation can be executed with the measured temperature of the fixing belt 21, then the printing operation starts, conveying the sheets P at increased intervals, for example. By contrast, if the controller 90 determines that the normal fixing operation cannot be executed with the measured temperature of the fixing belt 21, then the controller 90 halts the operation of the image forming apparatus 100 and restarts the image forming apparatus 100.

Although this procedure can be applied to the first through fourth control examples described above, a description is now given of an example of applying this procedure to the fourth control example.

The fifth control example illustrated in FIG. 13 starts with receiving the request for start of continuous printing. When the controller 90 receives the request, the voltmeter 85 of the power supply 80 measures an input voltage that is input from the outlet 301 via the power plug 81 and the power code in step S501.

Subsequently in step S502, the controller 90 determines whether the measured voltage is equal to or higher than the predetermined reference voltage.

If the controller 90 determines that the measured voltage is equal to or higher than the reference voltage (Yes in S502), then the controller 90 starts control relative to the printing operation in normal productivity in step S503.

By contrast, if the controller 90 determines that the measured voltage is not equal to or higher than the reference voltage, that is, the measured voltage is lower than the reference voltage (No in S502), then the controller 90 determines whether the measured voltage is equal to or higher than the voltage for stopping operation in step S504.

If the controller 90 determines that the measured voltage is equal to or higher than the voltage for stopping operation (Yes in S504), then the printing operation starts, conveying the sheets P at increased intervals in step S505. Subsequently in step S506, the controller 90 determines whether the predetermined productivity recovery requirements are satisfied.

If the controller 90 determines that the productivity recovery requirements are satisfied (Yes in S506), then the controller 90 starts control relative to the printing operation in normal productivity in step S503. By contrast, if the controller 90 determines that the productivity recovery requirements are not satisfied (No in S506), then the printing operation continues while conveying the sheets P at increased intervals in S505. The controller 90 repeats determination of whether the productivity recovery requirements are satisfied (in S506) at regular intervals until printing is completed.

If the controller 90 determines that the measured voltage is not equal to or higher than the voltage for stopping operation (No in S504), then the controller 90 executes the following control.

The controller 90 controls the heater 23 to execute a predetermined heating operation and rotates the pressure roller 22 a whole time during the heating operation. Then, the controller 90 activates the temperature sensor 28 to measure the surface temperature of the fixing belt 21 after heating in step S507.

Subsequently in step S508, the controller 90 determines whether the fixing operation can be executed with the measured temperature of the fixing belt 21, that is, whether the measured temperature of the fixing belt 21 is equal to or higher than a predetermined target fixing temperature.

If the controller 90 determines that the measured temperature of the fixing belt 21 is equal to or higher than the target fixing temperature (Yes in S508), then the printing operation starts, conveying the sheets P at increased intervals in step S505.

By contrast, if the controller 90 determines that the measured temperature of the fixing belt 21 is not equal to or higher than the target fixing temperature (No in S508), then the controller 90 halts the operation of the image forming apparatus 100 and restarts the image forming apparatus 100 in step S509.

According to the fifth control example, the controller 90 controls the components of the image forming apparatus 100 as follows in addition to the fourth control example.

If the measured voltage is lower than the predetermined voltage for stopping operation, then the heater 23 executes the predetermined heating operation and the temperature sensor 28 measures the temperature of the fixing belt 21 increased by heating. The controller 90 determines whether the measured temperature of the fixing belt 21 is equal to or higher than the predetermined target fixing temperature that allows the normal fixing operation. If the controller 90 determines that the measured temperature of the fixing belt 21 is equal to or higher than the target fixing temperature, then the printing operation starts. By contrast, if the controller 90 determines that the measured temperature of the fixing belt 21 is lower than the target fixing temperature, then the controller 90 halts the operation of the image forming apparatus 100 and restarts the image forming apparatus 100.

With such control, the image forming apparatus 100 has advantages as follows.

Even if the measured voltage is lower than the predetermined voltage for stopping operation, the printing operation starts without restarting the image forming apparatus 100, provided that the temperature of the fixing belt 21 increased by the heating operation of the heater 23 is equal to or higher than the target fixing temperature.

Accordingly, the image forming apparatus 100 prevents an image failure that may be caused by the temperature drop of the fixing belt 21 due to decrease in voltage that is input to the image forming apparatus 100, while reducing downtime of the image forming apparatus 100.

Figures 14, 14A:
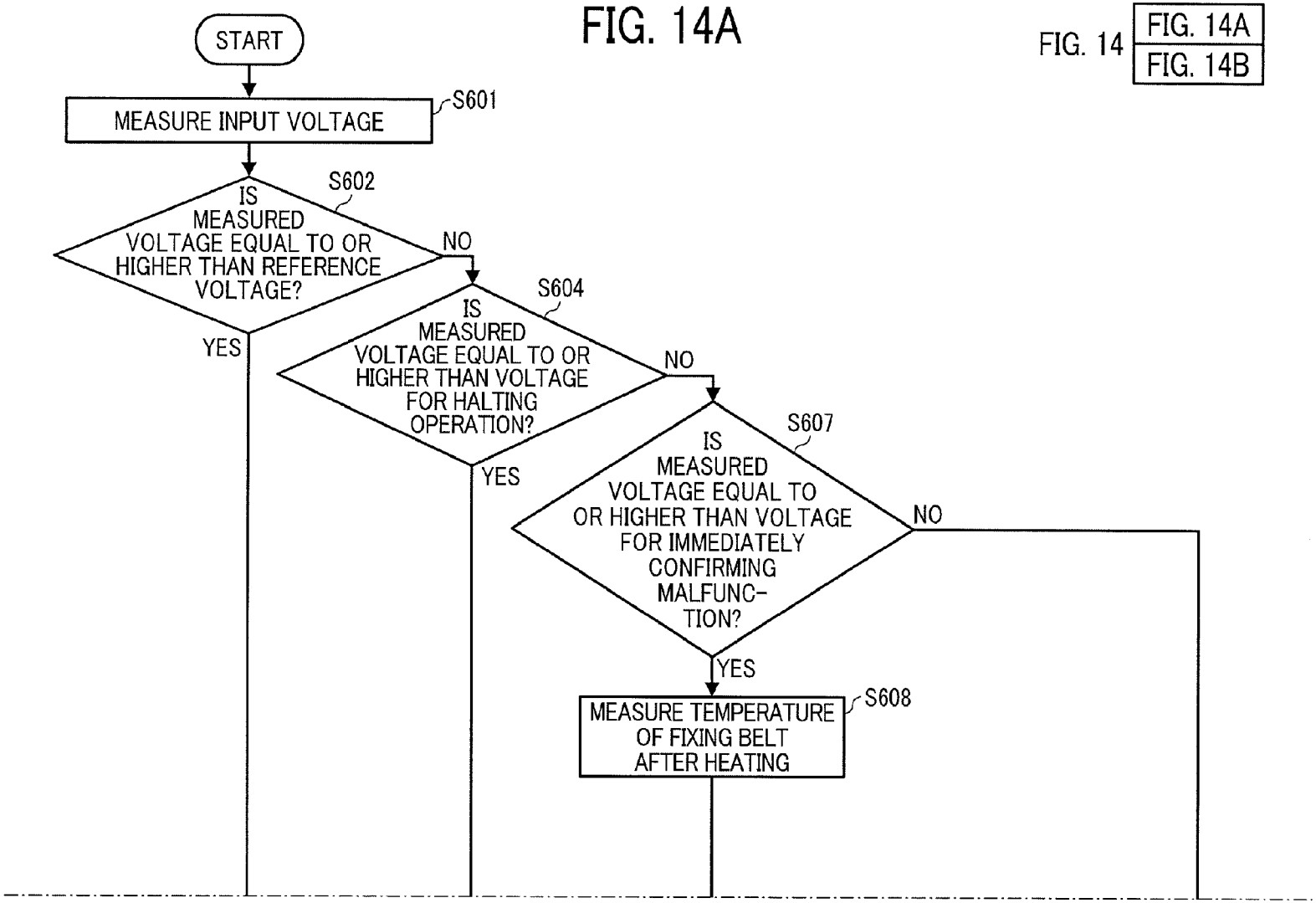
FIG. 14A is a flowchart of a sixth example of the operation control executed by the controller of the image forming apparatus of FIG. 1.
Figure 14B:
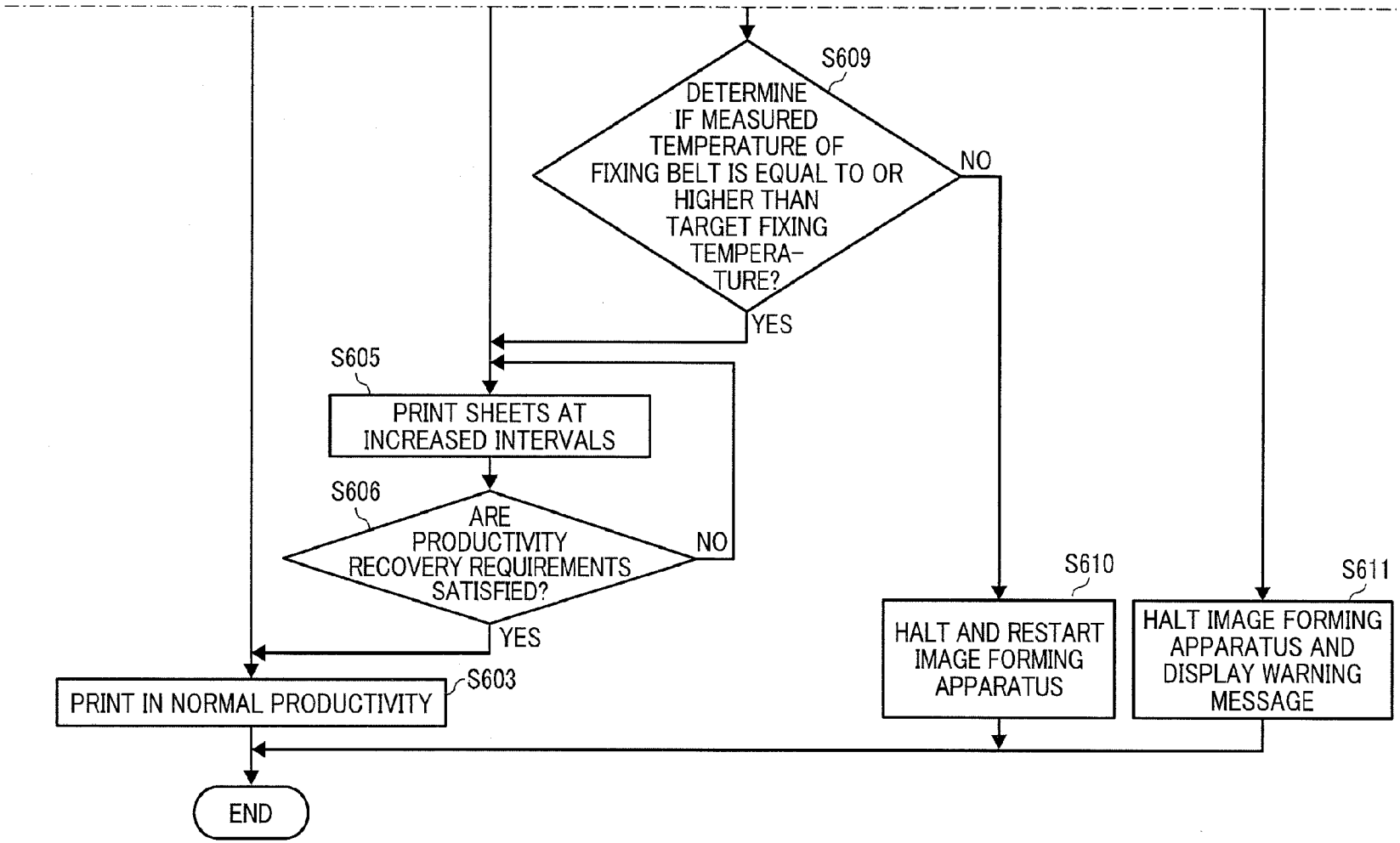
FIG. 14B is a continuation of the flowchart of the sixth example of the operation control in FIG. 14A.

Referring now to FIGS. 14A and 14B, a description is given of a sixth example of the operation control executed by the controller 90 of the image forming apparatus 100.

FIG. 14A is a flowchart of the sixth example of the operation control. FIG. 14B is a continuation of the flowchart of the sixth example of the operation control in FIG. 14A.

According to the fourth and fifth control examples described above, the image forming apparatus 100 may be restarted if the input voltage is too low. According to the first through third control examples described above, the image forming apparatus 100 may be restarted manually if the image forming apparatus 100 suddenly stops working or causes fixing failures.

However, an excessively low input voltage may hamper a normal restart (I.e., restart after a halt) of the image forming apparatus 100. For example, although the heater 23 can execute the heating operation such as turning on a halogen lamp, the controller 90 (CPU) controlling the heater 23 might go out of control and fail to restart the image forming apparatus 100 normally.

Hence, in the sixth control example, if the input voltage is lower than a predetermined voltage for immediately confirming malfunction, then the controller 90 halts the operation of the image forming apparatus 100, without allowing the heater 23 to execute the heating operation or restarting the image forming apparatus 100, while indicating that the input voltage is too low.

For example, the controller 90 may send a warning message to an external device such as a computer via the external I/F of the image forming apparatus 100. Alternatively, the controller 90 may display a warning message on the operation/display device of the image forming apparatus 100.

Although this procedure can be applied to the first through fifth control examples described above, a description is now given of an example of applying this procedure to the fifth control example.

The sixth control example illustrated in FIGS. 14A and 14B starts with receiving the request for start of continuous printing. When the controller 90 receives the request, the voltmeter 85 of the power supply 80 measures an input voltage that is input from the outlet 301 via the power plug 81 and the power code in step S601.

Subsequently in step S602, the controller 90 determines whether the measured voltage is equal to or higher than the predetermined reference voltage.

If the controller 90 determines that the measured voltage is equal to or higher than the reference voltage (Yes in S602), then the controller 90 starts control relative to the printing operation in normal productivity in step S603.

By contrast, if the controller 90 determines that the measured voltage is not equal to or higher than the reference voltage, that is, the measured voltage is lower than the reference voltage (No in S602), then the controller 90 determines whether the measured voltage is equal to or higher than the voltage for stopping operation in step S604.

If the controller 90 determines that the measured voltage is equal to or higher than the voltage for stopping operation (Yes in S604), then the printing operation starts, conveying the sheets P at increased intervals in step S605. Subsequently in step S606, the controller 90 determines whether the predetermined productivity recovery requirements are satisfied.

If the controller 90 determines that the productivity recovery requirements are satisfied (Yes in S606), then the controller 90 starts control relative to the printing operation in normal productivity in step S603. By contrast, if the controller 90 determines that the productivity recovery requirements are not satisfied (No in S606), then the printing operation continues while conveying the sheets P at increased intervals in S605. The controller 90 repeats determination of whether the productivity recovery requirements are satisfied (in S606) at regular intervals until printing is completed.

If the controller 90 determines that the measured voltage is not equal to or higher than the voltage for stopping operation (No in S604), then the controller 90 determines whether the measured voltage is equal to or higher than the voltage for immediately confirming malfunction in step S607.

If the controller 90 determines that the measured voltage is equal to or higher than the voltage for immediately confirming malfunction (Yes in S607), then the controller 90 executes the following control.

The controller 90 controls the heater 23 to execute the predetermined heating operation and rotates the pressure roller 22 a whole time during the heating operation. Then, the controller 90 activates the temperature sensor 28 to measure the surface temperature of the fixing belt 21 after heating in step S608.

Subsequently in step S609, the controller 90 determines whether the fixing operation can be executed with the measured temperature of the fixing belt 21, that is, whether the measured temperature of the fixing belt 21 is equal to or higher than the predetermined target fixing temperature.

If the controller 90 determines that the measured temperature of the fixing belt 21 is equal to or higher than the target fixing temperature (Yes in S609), then the printing operation starts, conveying the sheets P at increased intervals in step S605.

By contrast, if the controller 90 determines that the measured temperature of the fixing belt 21 is not equal to or higher than the target fixing temperature (No in S609), then the controller 90 halts the operation of the image forming apparatus 100 and restarts the image forming apparatus 100 in step S610.

If the controller 90 determines that the measured voltage is not equal to or higher than the voltage for immediately confirming malfunction, that is, the measured voltage is lower than the voltage for immediately confirming malfunction (No in S607), then the controller 90 halts the operation of the image forming apparatus 100 while indicating malfunction in step S611.

Unlike the fourth and fifth control examples in which the input voltage is divided into three levels, the input voltage is divided into four levels by three threshold voltages in the sixth control example.

Specifically, the three threshold voltages are predetermined as follows: the reference voltage (threshold voltage 1); the voltage for stopping operation (threshold voltage 2); and the voltage for immediately confirming malfunction (threshold voltage 3). The four levels are specified as follows: a first level equal to or higher than the reference voltage (normal voltage); a second level lower than the reference voltage and equal to or higher than the voltage for stopping operation; a third level lower than the voltage for stopping operation and equal to or higher than the voltage for immediately confirming malfunction; and a fourth level lower than the voltage for immediately confirming malfunction.

The threshold voltages described above depend on the apparatus configuration. For example, in the present control example, the threshold voltages are specified as follows based on a Japanese standard voltage of 100 V (101±6 V):

85 V for the reference voltage (threshold voltage 1) that defines the first level of the input voltage of from about 85 V to about 100 V for executing the normal operation; 70 V for the voltage for stopping operation (threshold voltage 2) that defines the second level of the input voltage of from about 70 V to about 85 V for executing the operations described above in the first through fourth control examples; and 50 V for the voltage for immediately confirming malfunction (threshold voltage 3) that defines the third level of the input voltage of from about 50 V to about 70 V for restarting the image forming apparatus 100 and the fourth level of the input voltage lower than about 50 V for halting the operation of the image forming apparatus 100 and indicating malfunction.

According to the sixth control example, the controller 90 controls the components of the image forming apparatus 100 as follows in addition to the fifth control example.

If the measured voltage is lower than the predetermined voltage for immediately confirming malfunction, which is lower than the predetermined reference voltage, then the controller 90 halts the operation of the image forming apparatus 100, without allowing the heater 23 to execute the heating operation or restarting the image forming apparatus 100 while indicating that the input voltage is too low by, e.g., sending a warning message to a user's computer.

With such control, the image forming apparatus 100 has advantages as follows.

If the measured voltage is lower than the voltage for immediately confirming malfunction, that is, the input voltage is too low, such an excessively low input voltage may hamper a normal restart of the image forming apparatus 100.

Hence, in the present control example, if the measured voltage is lower than the voltage for immediately confirming malfunction, then the controller 90 halts the operation of the image forming apparatus 100 while indicating that the input voltage is too low, thereby suppressing unnecessary downtime of the image forming apparatus 100.

Although specific embodiments and examples are described, the embodiments and examples according to the present disclosure are not limited to those specifically described herein. Several aspects of the image forming apparatus are exemplified as follows.

A description is now given of an aspect A of the image forming apparatus.

An image forming apparatus (e.g., image forming apparatus 100) includes a fixing device (e.g., fixing device 20) and a controller (e.g., controller 90). The fixing device fixes a toner image (e.g., toner image T) onto a recording medium (e.g., sheet P). The fixing device includes an endless fixing rotator (e.g., fixing belt 21), a heater (e.g., heater 23), a pressure pad (e.g., nip formation pad 24), and a pressure rotator (e.g., pressure roller 22). The fixing rotator is rotatable in a given direction of rotation (e.g., rotational direction R1) and formed into a loop. The heater heats the fixing rotator. The pressure pad is disposed inside the loop formed by the fixing rotator. The pressure rotator is disposed opposite the pressure pad via the fixing rotator. The pressure rotator presses the fixing rotator against the pressure pad to form a fixing nip (e.g., fixing nip N) between the fixing rotator and the pressure rotator, through which the recording medium bearing the toner image is conveyed. The controller is operatively connected to the fixing device. Based on an input voltage from an external source (e.g., outlet 301), the controller controls a heating operation of the heater and a fixing operation of the fixing device to fix the toner image onto the recording medium. For example, the controller controls the heater to heat the fixing rotator before conveyance of the recording medium. The controller adjusts the time to convey the recording medium bearing the toner image through the fixing nip, or changes a spatial interval between consecutive recording media conveyed.

Such an image forming apparatus has some or all of the following advantages, enumeration of which is not exhaustive or limiting.

For example, if the input voltage is lower than a predetermined reference voltage that allows the heater to heat the fixing rotator to a target fixing temperature, start of image formation is delayed so that the heater heats the fixing rotator to the target fixing temperature before image formation starts.

Upon continuous image formation, if the input voltage is lower than the reference voltage, consecutive recording media subject to image formation are conveyed at increased intervals so that the heater heats the fixing rotator to the target fixing temperature between the consecutive recording media conveyed, thereby maintaining the temperature of the fixing rotator equal to or higher than a given temperature.

Accordingly, the image forming apparatus prevents an image failure that may be caused by the temperature drop of the fixing rotator due to decrease in voltage that is input to the image forming apparatus.

A description is now given of an aspect B of the image forming apparatus.

In the aspect A, the fixing device further includes a thermal storage (e.g., thermal storage 27) between the pressure pad and the fixing rotator. The pressure pad includes a base (e.g., base 24*a*). The fixing device further includes a thermal storage (e.g., thermal storage 27) between the pressure pad and the fixing rotator. The thermal storage is made of a material having a larger thermal capacity than a thermal capacity of the base of the pressure pad, such as copper, aluminum, or nickel.

Such an image forming apparatus has some or all of the following advantages, enumeration of which is not exhaustive or limiting.

Even when the input voltage slightly varies, the thermal storage stores heat generated by the heater and supplies the fixing rotator with the heat thus stored. Accordingly, the image forming apparatus enhances prevention of an image failure that may be caused by the temperature drop of the fixing rotator due to decrease in voltage that is input to the image forming apparatus, compared to typical image forming apparatuses that incorporate a fixing device without a thermal storage.

For example, if the input voltage is lower than the predetermined reference voltage that allows the heater to heat the fixing rotator to the target fixing temperature, start of image formation is delayed so that the thermal storage stores heat generated by the heater before image formation starts and that the thermal storage supplies the heat thus stored to the fixing rotator after image formation starts.

Upon continuous image formation, if the input voltage is lower than the reference voltage, the consecutive recording media subject to image formation are conveyed at increased intervals so that the heater supplies heat to the thermal storage between the consecutive recording media conveyed. As a consequence, the thermal storage maintains a given amount of heat while the fixing rotator remains at a given temperature or higher.

Since the thermal storage is interposed between the pressure pad and the fixing rotator, the thermal storage efficiently stores the heat generated by the heater and transmits the heat thus stored to the fixing rotator having a decreased temperature.

A description is now given of an aspect C of the image forming apparatus.

In the aspect A or B, the heater is, e.g., a halogen heater that heats the fixing rotator by radiation, e.g., by radiating heat. The fixing device further includes a temperature detector (e.g., temperature sensor 28), a shield (e.g., heat shield 29), and a driver (e.g., drive motor 29A). The temperature detector detects the temperature of the fixing rotator. The shield shields the fixing rotator from the radiation from the heater. The driver moves the shield to change a shielding area of the shield.

Such an image forming apparatus has some or all of the following advantages, enumeration of which is not exhaustive or limiting.

Even if a plurality of relatively small or narrow recording media are conveyed through the fixing device continuously, a non-conveyance span of the fixing rotator where the recording media are not conveyed does not overheat. Thus, the fixing device removes needless control, such as degradation of productivity, for eliminating an excessive temperature rise in the non-conveyance span of the fixing rotator. That is, the fixing device reduces possibility of thermal degradation of the internal components of the fixing device, without executing needless control, such as degradation of productivity, for eliminating an excessive temperature rise in the non-conveyance span of the fixing rotator.

A description is now given of an aspect D of the image forming apparatus.

In any one of the aspects A through C, the image forming apparatus further includes a power supply (e.g., power supply 80) that includes a voltmeter (e.g., voltmeter 85). The voltmeter measures the input voltage from an external source. Based on the input voltage measured by the voltmeter, the controller controls an image forming operation to form the toner image on the recording medium and the fixing operation to fix the toner image onto the recording medium.

Such an image forming apparatus has some or all of the following advantages, enumeration of which is not exhaustive or limiting.

For example, if the input voltage is lower than the predetermined reference voltage that allows the fixing rotator to heat the fixing rotator to the target fixing temperature when the controller receives a request for start of image formation, start of image formation is delayed so that the heater heats the fixing rotator to the target fixing temperature before the fixing operation starts.

Upon continuous image formation, if the input voltage is lower than the reference voltage, the consecutive recording media subject to image formation are conveyed at increased intervals so that the heater heats the fixing rotator to the target fixing temperature between the consecutive recording media conveyed, thereby maintaining the temperature of the fixing rotator equal to or higher than a given temperature.

Accordingly, the image forming apparatus prevents a temperature drop of the fixing rotator due to decrease in voltage that is input to the image forming apparatus, thereby further preventing an image failure.

A description is now given of an aspect E of the image forming apparatus.

In the aspect D, if the voltage measured by the voltmeter is lower than a predetermined reference voltage, start of the image forming operation is delayed, compared to when a normal voltage equal to or higher than the reference voltage is input, until after the thermal storage stores heat from the heater.

Such an image forming apparatus has some or all of the following advantages, enumeration of which is not exhaustive or limiting.

For example, if the input voltage is lower than the reference voltage that allows the fixing rotator to heat the fixing rotator to the target fixing temperature, start of image formation is delayed so that the heater heats the fixing rotator to the target fixing temperature and that thermal storage stores heat generated by the heating operation of the heater. After the image forming operation starts, the thermal storage supplies the heat thus stored to the fixing rotator.

Accordingly, the image forming apparatus prevents a temperature drop of the fixing rotator due to decrease in voltage that is input to the image forming apparatus, thereby further preventing an image failure.

A description is now given of an aspect F of the image forming apparatus.

In the aspect D or E, if the voltage measured by the voltmeter is lower than a predetermined reference voltage, the recording medium and a following recording medium are conveyed at an increased interval during a continuous image forming operation, compared to when a normal voltage equal to or higher than the reference voltage is input.

Such an image forming apparatus has some or all of the following advantages, enumeration of which is not exhaustive or limiting.

If the input voltage is lower than the reference voltage, the consecutive recording media subject to image formation are conveyed at increased intervals so that the heater heats the fixing rotator and supply heat to the thermal storage. As a consequence, the temperature of the fixing rotator and the heat stored in the thermal storage are maintained. In other words, the fixing rotator and the thermal storage remain at a given temperature or higher.

Accordingly, the image forming apparatus prevents a temperature drop of the fixing rotator due to decrease in voltage that is input to the image forming apparatus, thereby further preventing an image failure.

A description is now given of an aspect G of the image forming apparatus.

In the aspect F, if the voltage measured by the voltmeter is lower than the predetermined reference voltage and if a predetermined productivity recovery requirement is satisfied after the continuous image forming operation starts, conveying the recording medium and the following recording medium at the increased interval, a spatial interval between the recording medium and the following recording medium is returned to a regular spatial interval at which the recording medium and the following recording medium are conveyed when the normal voltage is input.

Such an image forming apparatus has some or all of the following advantages, enumeration of which is not exhaustive or limiting.

When image formation starts, conveying the consecutive recording media at increased intervals, and when the temperature of the fixing rotator and the thermal storage increases to a sufficient temperature, the spatial interval between the recording media is returned to the regular spatial interval at which the recording media are conveyed when the normal voltage is input, thereby enhancing usability of the image forming apparatus. In particular, when narrower recording media are conveyed, heat is continuously supplied to a non-conveyance span of the thermal storage where the recording media are not conveyed. That is, the temperature of the thermal storage is likely to increase, allowing the spatial interval between the recording media to be returned to the regular spatial interval earlier than when wider recording media are conveyed.

Accordingly, the image forming apparatus prevents a temperature drop of the fixing rotator due to decrease in voltage that is input to the image forming apparatus, thereby further preventing an image failure.

A description is now given of an aspect H of the image forming apparatus.

In any one of the aspects D through G, a plurality of threshold voltages is predetermined, such as a reference voltage (threshold voltage 1) and a voltage for stopping operation (threshold voltage 2). By the plurality of threshold voltages, a plurality of voltage levels is predetermined, such as a first level equal to or higher than the reference voltage (normal voltage), a second level lower than the reference voltage and equal to or higher than the voltage for stopping operation, and a third level lower than the voltage for stopping operation. The controller identifies a level of the input voltage measured by the voltmeter among the plurality of voltage levels, and determines whether to execute the image forming operation and the fixing operation or restart the image forming apparatus based on the level thus identified.

Such an image forming apparatus has some or all of the following advantages, enumeration of which is not exhaustive or limiting.

Avoiding needless control efficiently prevents an image failure that may be caused by the temperature drop of the fixing rotator due to decrease in voltage input to the image forming apparatus.

In addition, recovery of the input voltage is confirmed while the image forming apparatus is restarted.

A description is now given of an aspect 1 of the image forming apparatus.

In any one of the aspects D through H, the fixing device further includes a temperature detector to detect a temperature of the fixing rotator. If the voltage measured by the voltmeter is lower than a predetermined voltage for determining whether operation of the image forming apparatus can be executed such as the voltage for stopping operation, the temperature detector detects the temperature of the fixing rotator after the heater executes a predetermined heating operation to heat the fixing rotator. The controller determines whether the temperature of the fixing rotator detected by the temperature detector is equal to or higher than a predetermined target fixing temperature allowing a normal fixing operation. If the controller determines that the temperature of the fixing rotator detected by the temperature detector is equal to or higher than the target fixing temperature, the image forming operation starts. If the controller determines that the temperature of the fixing rotator detected by the temperature detector is lower than the target fixing temperature, the image forming apparatus is restarted.

Such an image forming apparatus has some or all of the following advantages, enumeration of which is not exhaustive or limiting.

Even if the input voltage measured by the voltmeter is lower than the predetermined voltage for determining whether operation of the image forming apparatus can be executed, the image forming operation starts without restarting the image forming apparatus, provided that the temperature of the fixing rotator increased by the heating operation of the heater is equal to or higher than the target fixing temperature.

Accordingly, the image forming apparatus prevents an image failure that may be caused by the temperature drop of the fixing rotator due to decrease in voltage that is input to the image forming apparatus, while reducing downtime of the image forming apparatus.

A description is now given of an aspect J of the image forming apparatus.

In any one of the aspects D through I, if the voltage measured by the voltmeter is lower than a predetermined voltage for identifying malfunction, such as a voltage for immediately confirming malfunction, the controller halts operation of the image forming apparatus, without allowing the heater to execute the heating operation or restarting the image forming apparatus, while indicating that the input voltage is too low by, e.g., sending a warning message to a user's computer. The predetermined voltage for identifying malfunction is lower than the predetermined voltage for determining whether operation of the image forming apparatus can be executed.

Such an image forming apparatus has some or all of the following advantages, enumeration of which is not exhaustive or limiting.

If the voltage measured by the voltmeter is lower than the voltage for identifying malfunction, that is, the input voltage is too low, such an excessively low input voltage may hamper a normal restart of the image forming apparatus.

Hence, if the measured voltage is lower than the voltage for identifying malfunction, the controller halts the operation of the image forming apparatus, without restarting the image forming apparatus, while indicating that the input voltage is too low, thereby suppressing unnecessary downtime of the image forming apparatus.

The present disclosure has been described above with reference to specific embodiments. It is to be noted that the present disclosure is not limited to the details of the embodiments described above, but various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

For example, the image forming apparatus incorporating the fixing device according to an embodiment described above is not limited to a color printer as illustrated in FIG. 1, but may be a monochrome printer that forms a monochrome toner image on a recording medium. In addition, the image forming apparatus to which the embodiments of the present disclosure are applied includes but is not limited to a printer, a copier, a facsimile machine, or a multifunction peripheral having one or more capabilities of these devices.

In particular, the fixing device described above is configured to directly heat a fixing belt or fixing rotator by a heater, in which the temperature of the fixing rotator may drop and cause a noticeable image failure in association with decrease in voltage that is input to the image forming apparatus. Alternatively, however, the embodiments of the present disclosure may be applied to the fixing device that is configured to indirectly heat the fixing rotator.

In addition, the image forming apparatus described above is configured to include a voltmeter in a power supply to measure voltage input to the image forming apparatus from an outlet, including commercial power and independent power generation. Alternatively, however, the voltmeter may be provided separately from the power supply.

Further, the controller described above is configured to measure the input voltage with the voltmeter, but is not limited to such a configuration. For example, a voltmeter may transmit a measured value to the controller. Alternatively, the voltmeter may transmit information to the controller whether the measured value is equal to or higher than a threshold, or equal to or lower than the threshold.

The voltmeter is not limited to the voltmeter described above that measures a specific voltage. Alternatively, the voltmeter may determine whether the input voltage is lower than a threshold as a reference voltage.

Any one of the above-described operations may be performed in various other ways, for example, in an order different from the one described above.

Further, any of the above-described devices or units can be implemented as a hardware apparatus, such as a special-purpose circuit or device, or as a hardware/software combination, such as a processor executing a software program.

Further, as described above, any one of the above-described and other methods of the present disclosure may be embodied in the form of a computer program stored in any kind of storage medium. Examples of storage mediums include, but are not limited to, flexible disk, hard disk, optical discs, magneto-optical discs, magnetic tapes, non-volatile memory cards, read-only memory (ROM), etc.

Alternatively, any one of the above-described and other methods of the present disclosure may be implemented by an application specific integrated circuit (ASIC), prepared by interconnecting an appropriate network of conventional component circuits or by a combination thereof with one or more conventional general purpose microprocessors and/or signal processors programmed accordingly.

What is claimed is:

1. An image forming apparatus comprising:

a fixing device to fix a toner image onto a recording medium, the fixing device including:

an endless, fixing rotator rotatable in a given direction of rotation and formed into a loop;

a heater to heat the fixing rotator;

a pressure pad disposed inside the loop formed by the fixing rotator; and a pressure rotator disposed opposite the pressure pad via the fixing rotator to press the fixing rotator against the pressure pad to form a fixing nip between the fixing rotator and the pressure rotator, through which the recording medium bearing the toner image is conveyed;

a voltmeter to measure an input voltage from an external source; and a controller operatively connected to the fixing device and the voltmeter, the controller controlling a heating operation of the heater and a fixing operation of the fixing device to fix the toner image onto the recording medium, based on the input voltage measured by the voltmeter, wherein the fixing device further comprises a temperature detector to detect a temperature of the fixing rotator, wherein, if the input voltage measured by the voltmeter is lower than a predetermined voltage for determining whether operation of the image forming apparatus can be executed, the temperature detector detects the temperature of the fixing rotator after the heater executes a predetermined heating operation to heat the fixing rotator, wherein the controller determines whether the temperature of the fixing rotator detected by the temperature detector is equal to or higher than a predetermined target fixing temperature allowing a normal fixing operation, wherein, if the controller determines that the temperature of the fixing rotator detected by the temperature detector is equal to or higher than the predetermined target fixing temperature, the image forming operation starts, and wherein, if the controller determines that the temperature of the fixing rotator detected by the temperature detector is lower than the predetermined target fixing temperature, the image forming apparatus is restarted.

2. The image forming apparatus according to claim 1, wherein the endless, fixing rotator is an endless belt.

3. The image forming apparatus according to claim 1, wherein the pressure rotator is a pressure roller.

4. The image forming apparatus according to claim 1, wherein the fixing device further comprises a thermal storage between the pressure pad and the fixing rotator, wherein the pressure pad includes a base, and wherein the thermal storage has a larger thermal capacity than a thermal capacity of the base of the pressure pad.

5. The image forming apparatus according to claim 4, wherein, if the input voltage measured by the voltmeter is lower than a predetermined reference voltage, the image forming operation starts after the thermal storage stores heat from the heater.

6. The image forming apparatus according to claim 1, wherein the heater heats the fixing rotator by radiation, and wherein the fixing device further comprises:

a temperature detector to detect a temperature of the fixing rotator;

a shield to shield the fixing rotator from the radiation from the heater; and a driver to move the shield to change a shielding area of the shield.

7. The image forming apparatus according to claim 6, wherein the heater is a halogen heater.

8. The image forming apparatus according to claim 1, wherein, if the input voltage measured by the voltmeter is lower than a predetermined reference voltage, the recording medium and a following recording medium are conveyed at an increased interval during a continuous image forming operation, compared to when a normal voltage equal to or higher than the predetermined reference voltage is input.

9. The image forming apparatus according to claim 8, wherein, if the input voltage measured by the voltmeter is lower than the predetermined reference voltage and if a predetermined productivity recovery requirement is satisfied after the continuous image forming operation starts, conveying the recording medium and the following recording medium at the increased interval, a spatial interval between the recording medium and the following recording medium is returned to a regular spatial interval at which the recording medium and the following recording medium are conveyed when the normal voltage is input.

10. The image forming apparatus according to claim 1, wherein the controller identifies a level of the input voltage measured by the voltmeter among predetermined voltage levels, and wherein the controller determines whether to execute the image forming operation and the fixing operation or restart the image forming apparatus based on the level thus identified.

11. The image forming apparatus according to claim 1, wherein, if the input voltage measured by the voltmeter is lower than a predetermined voltage for identifying malfunction further lower than the predetermined voltage for determining whether operation of the image forming apparatus can be executed, the controller halts operation of the image forming apparatus while indicating that the input voltage is too low.

12. The image forming apparatus according to claim 11, wherein if the input voltage measured by the voltmeter is lower than a predetermined voltage for identifying malfunction further lower than the predetermined voltage for determining whether operation of the image forming apparatus can be executed the heater does not execute the heating operation and the controller does not restart the image forming apparatus.

* * * * *